US009013467B2

(12) United States Patent
Sisto

(10) Patent No.: US 9,013,467 B2
(45) Date of Patent: Apr. 21, 2015

(54) CONTROLLED OPERATION OF A LED LIGHTING SYSTEM AT A TARGET OUTPUT COLOR

(71) Applicant: Institut National d'Optique, Quebec (CA)

(72) Inventor: Marco Michele Sisto, Quebec (CA)

(73) Assignee: Institut National d'Optique, Quebec, Quebec (CA)

( * ) Notice: Subject to any disclaimer, the term of this patent is extended or adjusted under 35 U.S.C. 154(b) by 168 days.

(21) Appl. No.: 13/946,155

(22) Filed: Jul. 19, 2013

(65) Prior Publication Data

US 2015/0022110 A1 Jan. 22, 2015

(51) Int. Cl.
*G09G 5/00* (2006.01)
*H05B 33/08* (2006.01)

(52) U.S. Cl.
CPC ..... *H05B 33/0866* (2013.01)

(58) Field of Classification Search
USPC ..... 315/209 R, 224, 291, 185 S, 307–326, 315/362; 345/102, 204, 211–214, 82
See application file for complete search history.

(56) References Cited

U.S. PATENT DOCUMENTS

| | | | |
|---|---|---|---|
| 6,411,046 | B1 | 6/2002 | Muthu |
| 6,552,495 | B1 | 4/2003 | Chang |
| 6,630,801 | B2 | 10/2003 | Schuurmans |
| 7,067,995 | B2 | 6/2006 | Gunter et al. |
| 7,208,713 | B2 | 4/2007 | Ishiguchi |
| 7,319,298 | B2 | 1/2008 | Jungwirth et al. |
| 7,397,205 | B2 | 7/2008 | Huang et al. |
| 7,719,208 | B2 | 5/2010 | Li et al. |
| 7,868,562 | B2 | 1/2011 | Salsbury et al. |
| 7,990,083 | B2 | 8/2011 | Deurenberg et al. |
| 8,013,533 | B2 | 9/2011 | De Rijck et al. |
| 8,110,995 | B2 | 2/2012 | Deurenberg |
| 8,115,779 | B2 | 2/2012 | Ackermann |
| 8,174,210 | B2 | 5/2012 | Delnoij |
| 8,278,847 | B2 | 10/2012 | Chen et al. |
| 2007/0200513 | A1 | 8/2007 | Ha et al. |

(Continued)

FOREIGN PATENT DOCUMENTS

| | | | |
|---|---|---|---|
| EP | 2469982 | A1 | 6/2012 |

OTHER PUBLICATIONS

Tanaka et al., Color Control of a Lighting System Using RGBW LEDs, Proc. SPIE 7866, Color Imaging XVI: Displaying, Processing, Hardcopy, and Application, Jan. 25, 2011.

(Continued)

*Primary Examiner* — Tuyet Vo
(74) *Attorney, Agent, or Firm* — Merchant & Gould P.C.

(57) ABSTRACT

A method for operating a LED lighting system has three or more LED emitters of different colors. The method allows finding the optimal drive setting for each LED emitter of the system, taking into account a specific target color. The method involves providing calibration data for each LED emitter at a plurality of values of drive setting and junction temperature, and executing a drive recursion loop calculating the drive setting of each emitter based on an input value for the temperature of each emitter and in view of the target output color and of the calibration data. Advantageously, this can be accomplished without measuring the color emitted by the LED lighting system, that is, no color feedback is required. A LED lighting system implementing the method is also disclosed.

30 Claims, 13 Drawing Sheets

(56) References Cited

U.S. PATENT DOCUMENTS

| | | | |
|---|---|---|---|
| 2009/0079358 | A1 | 3/2009 | Shteynberg et al. |
| 2010/0026193 | A1 | 2/2010 | Niedermeier |
| 2010/0060185 | A1 | 3/2010 | Van Duijneveldt |
| 2010/0264834 | A1 | 10/2010 | Gaines et al. |
| 2010/0301777 | A1 | 12/2010 | Kraemer |
| 2011/0057571 | A1 | 3/2011 | Ackermann et al. |
| 2011/0109232 | A1 | 5/2011 | Schulz et al. |
| 2012/0049743 | A1 | 3/2012 | Moskowitz |
| 2012/0169238 | A1 | 7/2012 | Lenderink |
| 2012/0242242 | A1 | 9/2012 | Linz et al. |

OTHER PUBLICATIONS

Qu et al., Color Control System for RGB LED Light Sources Using Junction Temperature Measurement, The 33rd Annual Conference of the IEEE Industrial Electronics Society, p. 1363-1368, Taiwan, Nov. 2007.

Shailesh K R et al., Novel Technique for Implementation of Color Algorithm for LED Used for General Illumination, IEEE International Advance Computing Conference, p. 201-203, India, Mar. 2009.

Buso et al., White Light Solid State Lamp With Luminance and Color Temperature Control, IEEE, p. 837-843, 2011.

Zong et al., New Practical Method for Measurement of High-Power LEDs, CIE Expert Symposium on Advances in Photometry and Colorimetry, p. 102-106, 2008.

| Current $I_n$ [mA] / Target junction temperature $T_{J,n}$ [°C] | 15 | 40 | ... | 400 | 700 |
|---|---|---|---|---|---|
| 20 | $X_n = 0.2$; $Y_n = 0.8$; $Z_n = 0.1$<br>$V_{J,n} = 2.6$ V<br>$T_{J,n} = 20.0$ °C<br>$X_{n,F}[1..15]$; $Y_{n,F}[1..15]$; $Z_{n,F}[1..15]$ | $X_n = 0.5$; $Y_n = 1.7$; $Z_n = 0.1$<br>$V_{J,n} = 2.7$ V<br>$T_{J,n} = 20.1$ °C<br>$X_{n,F}[1..15]$; $Y_{n,F}[1..15]$; $Z_{n,F}[1..15]$ | | $X_n = 2.3$; $Y_n = 10.4$; $Z_n = 1.8$<br>$V_{J,n} = 3.2$ V<br>$T_{J,n} = 20.0$ °C<br>$X_{n,F}[1..15]$; $Y_{n,F}[1..15]$; $Z_{n,F}[1..15]$ | $X_n = 3.1$; $Y_n = 14.5$; $Z_n = 3.3$<br>$V_{J,n} = 3.4$ V<br>$T_{J,n} = 20.5$ °C<br>$X_{n,F}[1..15]$; $Y_{n,F}[1..15]$; $Z_{n,F}[1..15]$ |
| 36 | $X_n = 0.2$; $Y_n = 0.8$; $Z_n = 0.1$<br>$V_{J,n} = 2.5$ V<br>$T_{J,n} = 36.1$ °C<br>$X_{n,F}[1..15]$; $Y_{n,F}[1..15]$; $Z_{n,F}[1..15]$ | $X_n = 0.5$; $Y_n = 1.7$; $Z_n = 0.2$<br>$V_{J,n} = 2.6$ V<br>$T_{J,n} = 36.0$ °C<br>$X_{n,F}[1..15]$; $Y_{n,F}[1..15]$; $Z_{n,F}[1..15]$ | | $X_n = 2.4$; $Y_n = 10.4$; $Z_n = 1.9$<br>$V_{J,n} = 3.2$ V<br>$T_{J,n} = 36.1$ °C<br>$X_{n,F}[1..15]$; $Y_{n,F}[1..15]$; $Z_{n,F}[1..15]$ | $X_n = 3.1$; $Y_n = 14.7$; $Z_n = 3.5$<br>$V_{J,n} = 3.4$ V<br>$T_{J,n} = 36.0$ °C<br>$X_{n,F}[1..15]$; $Y_{n,F}[1..15]$; $Z_{n,F}[1..15]$ |
| ... | | | | | |
| 67 | $X_n = 0.2$; $Y_n = 0.7$; $Z_n = 0.1$<br>$V_{J,n} = 2.4$ V<br>$T_{J,n} = 67.5$ °C<br>$X_{n,F}[1..15]$; $Y_{n,F}[1..15]$; $Z_{n,F}[1..15]$ | $X_n = 0.5$; $Y_n = 1.6$; $Z_n = 0.2$<br>$V_{J,n} = 2.5$ V<br>$T_{J,n} = 67.2$ °C<br>$X_{n,F}[1..15]$; $Y_{n,F}[1..15]$; $Z_{n,F}[1..15]$ | | $X_n = 2.4$; $Y_n = 10.2$; $Z_n = 2$<br>$V_{J,n} = 3.0$ V<br>$T_{J,n} = 67.2$ °C<br>$X_{n,F}[1..15]$; $Y_{n,F}[1..15]$; $Z_{n,F}[1..15]$ | $X_n = 3.2$; $Y_n = 14.4$; $Z_n = 3.6$<br>$V_{J,n} = 3.3$ V<br>$T_{J,n} = 67.5$ °C<br>$X_{n,F}[1..15]$; $Y_{n,F}[1..15]$; $Z_{n,F}[1..15]$ |
| 75 | $X_n = 0.2$; $Y_n = 0.7$; $Z_n = 0.1$<br>$V_{J,n} = 2.4$ V<br>$T_{J,n} = 75.5$ °C<br>$X_{n,F}[1..15]$; $Y_{n,F}[1..15]$; $Z_{n,F}[1..15]$ | $X_n = 0.5$; $Y_n = 1.6$; $Z_n = 0.2$<br>$V_{J,n} = 2.5$ V<br>$T_{J,n} = 75.7$ °C<br>$X_{n,F}[1..15]$; $Y_{n,F}[1..15]$; $Z_{n,F}[1..15]$ | | $X_n = 2.4$; $Y_n = 10$; $Z_n = 2$<br>$V_{J,n} = 3.0$ V<br>$T_{J,n} = 75.4$ °C<br>$X_{n,F}[1..15]$; $Y_{n,F}[1..15]$; $Z_{n,F}[1..15]$ | $X_n = 3.2$; $Y_n = 14.3$; $Z_n = 3.6$<br>$V_{J,n} = 3.2$ V<br>$T_{J,n} = 75.3$ °C<br>$X_{n,F}[1..15]$; $Y_{n,F}[1..15]$; $Z_{n,F}[1..15]$ |

FIG. 4

CONTROLLED OPERATION OF A LED LIGHTING SYSTEM AT A TARGET OUTPUT COLOR

FIELD OF THE INVENTION

The present invention relates to LED lighting systems, and more particularly concerns a color control method for multichromatic LED lighting systems.

BACKGROUND

Light-emitting diodes (LED) light sources, emitting either white light or colored light, are used for numerous applications such as interior and exterior lighting, decorative lighting, entertainment and the like. It is a recognized problem of the lighting industry that LED light sources must be carefully controlled in order to provide the best possible trade-off between requirements such as good electrical efficiency, high light intensity, color stability and color rendering.

In LED lighting systems having multiple LED emitters, the driving conditions of each emitter must be properly calibrated and controlled. Optimum driving conditions for each emitter must simultaneously take into account a specific target output color point as well as specific target light source intensity, and maintain both parameters stable over variations of environment temperature. In order to minimize the cost and complexity of a lighting system, it is desirable that appropriate LED driving conditions be obtained without resorting to color feedback, i.e., without measuring the light source emitted color, as this would require using expensive color sensors.

Identification of an appropriate drive condition for each LED emitter of a lighting system is nontrivial, since the color emitted by a LED emitter depends on the injected current and the LED junction temperature. As the LED dissipates heat when lit, the junction temperature is itself dependent on a number of parameters including the injected current, the junction voltage drop, the environment temperature and the efficiency at which the heat flowing from the junction to the environment is dissipated.

The drive condition of LED sources is often controlled by acting on the time-averaged forward current injected in the LED using some kind of current pulse modulation. A typical example is a PWM (Pulse Width Modulation) drive where the LED intensity is typically controlled by adjusting the duty cycle of a pulsed current waveform having constant predetermined maximum and minimum values (the latter being possibly set to zero). Various PWM schemes are known in the literature and may use a fixed or variable pulse frequency, constant or variable current values and complex waveforms. However, pulsed drive methods are affected by electromagnetic interference (EMI) problems and suffer from limitations on the achievable modulation depth. Furthermore, recent physiological studies demonstrate that slow PWM may create uncomfortable flickering of light. Minimizing the perceived flickering requires high frequency (>300 Hz) PWM, which may be hard and costly to implement.

PWM is nevertheless often chosen for LED driving as it is an energy efficient current modulation method. Furthermore, its implementation is relatively straightforward as the LED intensity is an approximately linear function of the PWM duty cycle.

Constant Current (CC) regulation is an alternative driving method that creates no flickering, low EMI and allows for larger variations of LED intensity. However, it can be energetically inefficient and cause large color variations.

Depending on the application, one method may be preferred over the other. Hence, it would be advantageous to provide a color control method which is applicable with all LED drivers, independently on the type of current control scheme.

Several methods based on simple linear models relating the junction temperature of each LED emitter to the emitted color are known in the art. However, these methods are effective only over a limited range of temperatures where the linear approximation is valid. Such methods may be inadequate for outdoor lighting subjected to largely-varying temperatures over the year. Furthermore, the temperature of a LED emitter can be highly dependent on the LED casing and the efficiency of the heat dissipation in the lighting source design. Dimming control adds to this problem as a LED dimmed to low intensity will experience a junction temperature near the environment temperature, while a fully lit LED may have a junction temperature many tens of degrees above the temperature of the environment.

The quality of the light generated by a LED lighting system affects the perceived colors of an illuminated scene: the color rendering property of a LED system is then another factor to be taken into account. Color rendering can be characterized using the CRI (color rendering index), which is a color rendering metric standardized by the CIE (Commission Internationale de l'Éclairage), or the CQS (Color Quality Scale), which is an alternative metric proposed by the NIST. For example, it is recognized in the literature that a CRI of at least 90 is desirable for lighting applications. The quality of color rendering is particularly meaningful for LED lighting systems that generate white light. A minimum of three primary colors are required for additive color synthesis of white light. LED lighting systems with only three LED emitters cannot provide white light with a CRI of at least 90. LED-based lighting systems having four or more LED emitters with different "primary" colors can be used to reach or to exceed the CRI threshold of 90 if appropriately controlled. However, one faces additional challenges when controlling LED lighting systems having more than three LED emitters with different "primary" colors. There remains a need in the field of high-end lighting applications employing additive color synthesis of white light for a LED control method capable of providing simultaneously a specified target white shade, a specified target intensity, and maximum color rendering as permitted by the controlled LED system.

The method should further allow maintaining these specified targets for the intensity and white shade over variations of environment temperature. Shades of white light are typically described by the light CCT (Correlated Color Temperature), but can also be described as a target color point in an appropriate color space.

There remains a need for a LED control method capable of maintaining a specified target light color over variations of light intensity (LED dimming) and environment temperature, without resorting to color feedback.

The known control methods rarely use the optimization of a color rendering metric as parameter for the control of LED emitters. In fact, the implementation of control methods that optimize the LED output according to a color rendering metric may be very demanding in terms of resources. The CRI color rendering metric (CRI) and many alternatives (such as the CQS) are based on a measurement of the light source spectrum. This requires the use of a spectrometer, a complex instrument that measures the light source spectrum. It is not convenient to include color feedback based on such an instrument as its cost is high.

Finally, there remains a need for a practical control method for operating a LED lighting system that can be effective over a large temperature range, and is applicable for various LED casing designs and for large dimming levels.

SUMMARY

In accordance with a first aspect of the invention, there is provided a method for operating a LED lighting system at a target output color. The LED system has three or more LED emitters of different colors, and each LED emitter is operable at a controllable emitter drive setting and has a junction temperature.

The method involves the steps of:

a) providing calibration data for each LED emitter at a plurality of values of the corresponding emitter drive setting and at a plurality of values of the corresponding junction temperature;

b) executing a drive recursion loop. The drive recursion loop calculates the drive setting of each emitter based on an input value for the junction temperature of each emitter, in view of the target output color and of the calibration data;

c) applying the drive settings obtained at step b) to the LED emitters;

d) determining an operation value for the junction temperature of each LED emitter;

e) executing the drive recursion loop calculating the drive setting of each emitter using the operation value of the junction temperature of each emitter as the input value therefor;

f) applying the drive settings obtained at step e) to the LED emitters; and g) repeating steps d) to f) for a predetermined number of times.

In accordance with another aspect of the invention, there is also provided a LED lighting system for operation at a target output color.

The LED lighting system includes three or more LED emitters of different colors, each having an junction temperature. A LED driver is associated with each LED emitter. Each LED driver is configured to apply a controllable emitter drive setting to the corresponding LED emitter.

The LED lighting system further includes a memory containing calibration data for each LED emitter at a plurality of values of the corresponding emitter drive setting and at a plurality of values of the corresponding junction temperature. The LED lighting system further includes a controller configured to execute a drive recursion loop. The drive recursion loop calculates the drive setting of each emitter based on an input value for the junction temperature of each emitter and in view of the target output color and of the calibration data.

The controller is further configured to:

a) execute the drive recursion loop a first time using an initial junction temperature as the input value therefor;

b) control each LED driver to apply the drive settings obtained through the recursion loop to the corresponding LED emitter;

c) determine an operation value for the junction temperature of each LED emitter;

d) execute the drive recursion loop using the operation value of the junction temperature of each emitter as the input value therefor;

e) control each LED driver to apply the drive settings obtained at step d) to the LED emitters; and f) repeat steps c) to e) for a predetermined number of iterations.

Other features and advantages of the invention will be better understood upon reading of preferred embodiments thereof with reference to the appended drawings.

BRIEF DESCRIPTION OF THE DRAWINGS

FIG. 4 shows a calibration table according to one embodiment, including tristimulus coordinates, a junction voltage, a junction temperature and coefficients used for color rendering metric optimization for a plurality of combinations of target junction temperature and drive current values.

DESCRIPTION OF EMBODIMENTS

Figure 1:
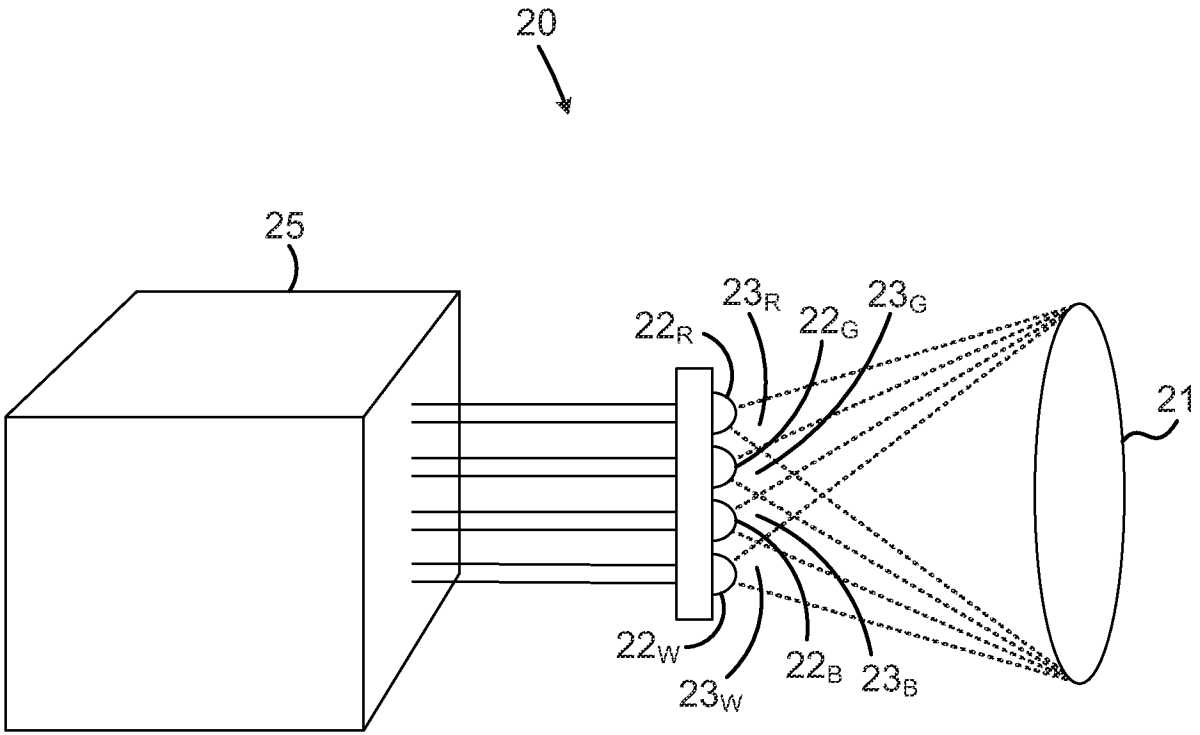
FIG. 1 is a perspective view of a multi-chromatic LED lighting system which can be controlled in accordance with embodiments of the invention.

In the following description, similar features in the drawings have been given similar reference numerals and in order to avoid weighing down the figures, some elements may not be referred to on some figures if they were already identified in preceding figures. It should also be understood herein that the elements of the drawings are not necessarily drawn to scale and that the emphasis is instead being placed upon clearly illustrating the elements and structures of the present embodiments.

The present invention generally relates to the control of multi-chromatic LED (Light-Emitting Diode) lighting systems. LED lighting systems may be used for numerous applications such as interior and exterior lighting, decorative lighting, entertainment and the like. Referring to FIG. 1, a LED lighting system 20 is shown by way of example. The LED lighting system 20 may include three, four or more LED emitters 22, each having a different color, controlled by appropriate control electronics 25. In typical three-emitter embodiments, the LED emitters 22 may for example embody a RGB scheme, the LED lighting system therefore including a red emitter $\mathbf{22}_R$, a green emitter $\mathbf{22}_G$ and a blue emitter $\mathbf{22}_B$. In the illustrated example of FIG. 1 a four-emitter embodiment is shown, where the fourth emitter may typically be a white emitter $\mathbf{22}_W$, therefore embodying a RGBW color scheme. Although the description below will mostly be applied to RGB and RGBW embodiments, it will be readily understood that the present invention may be applied to various color schemes or number of LED emitters. For example, some four-emitter LED devices use amber or yellow emitters instead of white ones, in addition to red, green and blue emitters.

As known in the art, the resulting light 21 generated by a LED lighting system is perceived as a colorimetric combination of the individual light beams $\mathbf{23}_R$, $\mathbf{23}_G$, $\mathbf{23}_B$ and $\mathbf{23}_W$ generated by the different LED emitters of the system. Varying the relative intensities of these light beams therefore provides a control of the resulting overall color.

Although the present description refers to LED systems made up of three or more LED emitters having different colors, one skilled in the art will understand that in practice, a LED system may include a greater number of emitters forming groups of same colored emitters, for example a group of red emitters, a group or green emitters and a group of blue emitters in a RGB scheme. The LED emitters of a same group may be electrically connected together or operated individually. It will be readily understood that in such cases the present method may be applied to one LED emitter of each group and the remaining LED emitters of the same group controlled according to the same parameters, or, alternatively, identical LED emitters may each be controlled according to the principles explained herein without departing from the scope of the present invention.

It will also be understood that referring to "LED emitters of different colors" is a shorthand for indicating that the light beams generated by the respective emitters have different colors.

Detailed Description of the LED Lighting System

Figure 2A:
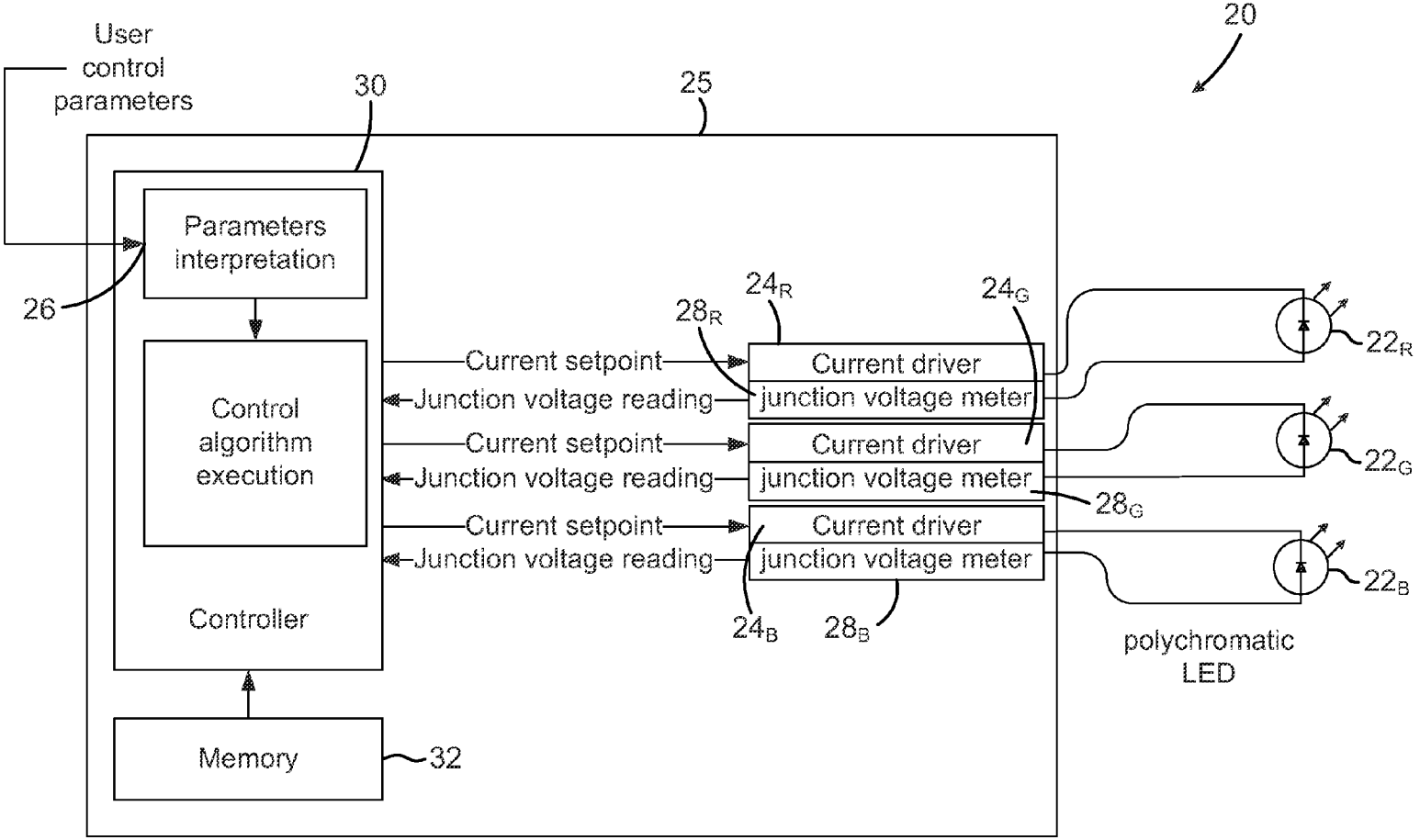
FIGS. 2A and 2B are schematic representations of LED lighting systems according to embodiments of the invention, respectively including three and four LED emitters.
Figure 2B:
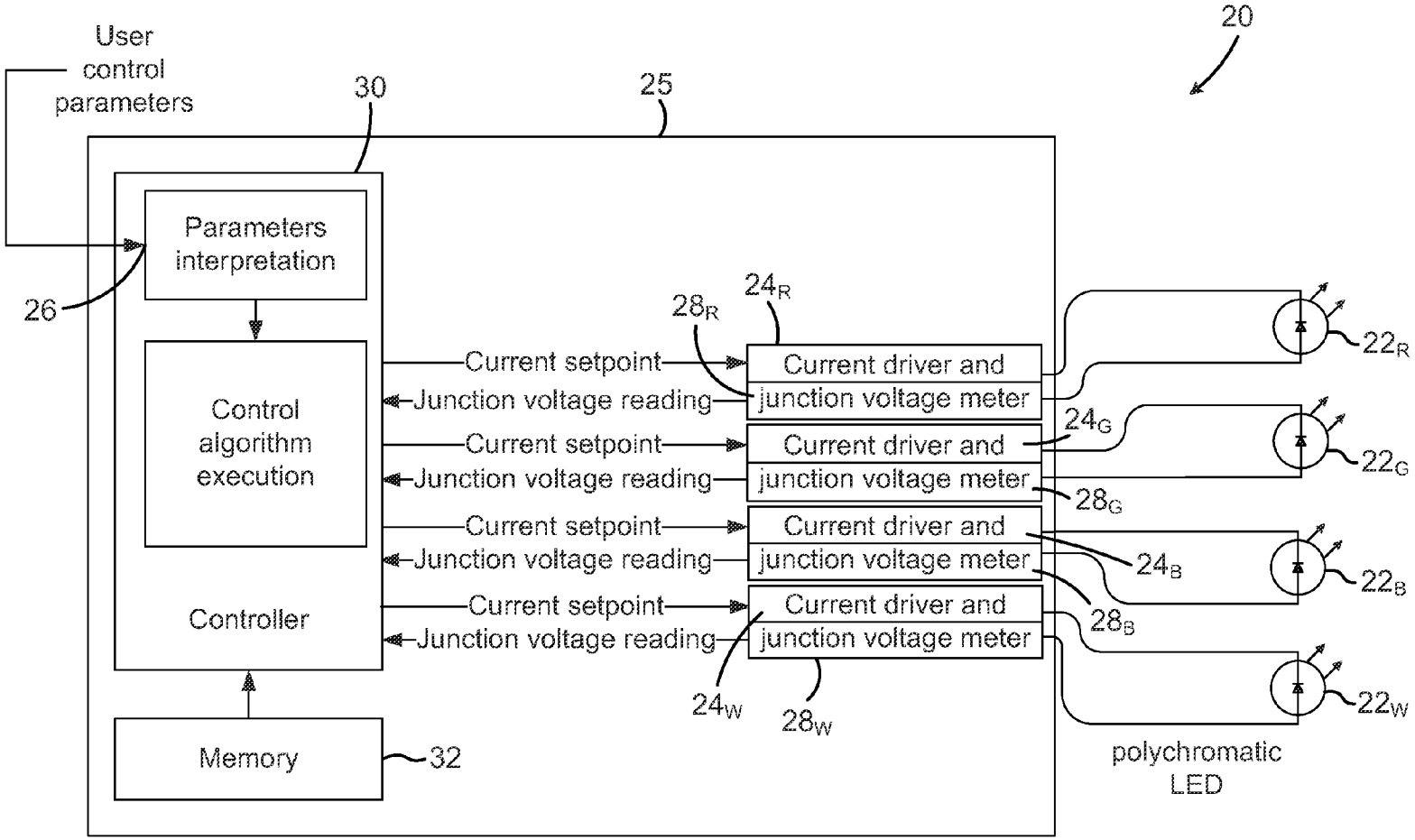

Referring to FIGS. 2A and 2B, the components of exemplary LED lighting systems 20 according to embodiments are schematically illustrated. The system 20 includes three or four LED emitters of different colors, here embodied by a red emitter $\mathbf{22}_R$, a green emitter $\mathbf{22}_G$ a blue emitter $\mathbf{22}_B$ in both embodiments of FIGS. 2A and 2B, and further including a white emitter $\mathbf{22}_W$ in the embodiment of FIG. 2B. A LED emitter is typically embodied by a chip made up of semiconductor materials doped with impurities, forming a p-n junction. An electrical current flows through the junction and it generates light of wavelength determined, among other factors, by the band-gap energy of the materials. Each LED emitter may be embodied by a "regular" or "direct emission" LED, or by a PCLED (phosphor-converted LED).

The LED system is configured for operation at a target color. The expression "target color" refers to the color of the light resulting from the combination of the light beams generated by the individual LED emitters of the LED lighting system. The target color may be described by color point coordinates in a given color space, i.e., by a model providing a specific mathematical representation of colors. Typical color spaces known in the art include the CIE 1931 XYZ and the CIELAB. CIE 1931 XYZ is historically the first attempt to describe colors on the basis of measurements of human color perception and it is the basis for almost all other color spaces. CIE 1931 XYZ is linear in terms of color mixing. This means that a target color can be expressed as linear combinations of N primary colors weighted by appropriate coefficients C. In matrix form:

$$\begin{bmatrix} X \\ Y \\ Z \end{bmatrix}_{target} = \begin{bmatrix} X_1 & & X_N \\ Y_1 & \dots & Y_N \\ Z_1 & & Z_N \end{bmatrix} \cdot \begin{bmatrix} C_1 \\ \vdots \\ C_N \end{bmatrix}.$$

where X, Y, Z are the tristimulus coordinates of the target color while $X_n$, $Y_n$ and $Z_n$ are tristimulus coordinates for each individual LED emitter n. The CIELAB is not linear in terms of color mixing but it is more linear than CIE 1931 XYZ in terms of color perception. Perceptual linearity means that a change of the same amount in the CIELAB coordinates produces a change of about the same visual importance in the colors represented by those coordinates. Direct and inverse transformation rules exist among common color spaces, so that a given color can be expressed univocally in any chosen color space.

Optionally, such as in the illustrated embodiments of FIGS. 2A and 2B, the lighting system 20 includes a user input 26 through which control parameters can be provided by the user. Preferably, the user control parameters may include the target color, which may be in the form of color point coordinates in a given color space or other information allowing deduction of the specific target color required by the user. The user control parameters may be provided through knobs, keyboard, mouse, touchscreen, or any other device providing a suitable user interface. It will however be understood that in other variants the target color may be preprogrammed, selected or deduced automatically without involving the intervention of a user.

Other user control parameters may optionally include luminance, Correlated Color Temperature (CCT), dominant wavelength, saturation, hue, etc.

The lighting system 20 further includes a LED driver 24 connected to each LED emitter 22. The illustrated embodiment of FIG. 2A therefore includes three LED drivers $\mathbf{24}_R$, $\mathbf{24}_G$, $\mathbf{24}_B$ while the embodiment of FIG. 2B further includes a fourth LED driver $\mathbf{24}_W$. The LED drivers 24 may be embodied by any device or combination of devices which can be configured to apply a controllable drive setting to the corresponding LED emitter. It will be readily understood that the intensity of the light generated by a LED emitter can be changed through a control of its driving conditions. Controlling the drive conditions of LED emitters is typically achieved by acting on the time-averaged forward current injected in the LED emitter.

In some embodiments the LED emitters 22 are controlled according to a PWM (Pulse Width Modulation) scheme. In this case the drive setting may be a current modulation duty cycle, that is, the duty cycle of a pulsed current waveform having constant predetermined maximum and minimum current values, the minimum current value being possibly an absence of current, i.e., a zero current value. Variants of PWM are known in the literature and may use a fixed or variable pulse frequency, constant or variable current values and complex waveforms. In PMW embodiments, each LED driver 24 includes for example a pulsed current source with controllable duty cycle.

In other embodiments the LED emitters may be driven according to a Constant Current (CC) regulation method where the drive setting would be embodied by a constant current value. In CC regulation embodiments, each LED driver 24 includes for example a continuous current source with controllable current amplitude.

Other driving methods, such as pulse frequency modulation, pulse density modulation or the like are also known in the art and considered to be within the scope of the present invention.

Each LED emitter 22 has a corresponding junction temperature. As a LED emitter dissipates heat when lit, the junction temperature depends on a number of parameters including the injected current, the junction voltage drop, the environment temperature and the efficiency of dissipation of the heat flowing from the junction to the environment. Since each LED emitter 22 can be operated under different drive conditions, the junction temperature may vary from emitter to emitter within a same LED lighting system 20.

The lighting system 20 may include a temperature determining module configured to measure, calculate or estimate the junction temperature of each LED emitter 22. In the illustrated embodiments the temperature determining module includes a junction voltage meter $\mathbf{28}_R$, $\mathbf{28}_G$, $\mathbf{28}_B$ and $\mathbf{28}_W$ connected to each LED emitter $\mathbf{22}_R$, $\mathbf{22}_G$, $\mathbf{22}_B$ and $\mathbf{22}_W$ in order to measure the corresponding junction voltage drop. The junction voltage drop may be used to determine the junction temperature, as will be explained further below.

Still referring to FIGS. 2A and 2B, the lighting system 20 further includes a controller 30. The controller 30 may be embodied by a microcontroller, a processor, an electronic circuit or by any other device or combination of devices providing the computing power required to perform the tasks described below. The controller 30 is configured to execute the steps of the method according to embodiments of the invention, which will be described further below.

The lighting system 20 further includes a memory 32 containing calibration data for each LED emitter. The calibration data includes entries at a plurality of values of the corresponding emitter drive setting and at a plurality of values of the corresponding junction temperature, as will also be explained further below. The memory may be embodied by any device or combination of devices apt to store the calibration data, such as a random-access memory (RAM), a programmable or non programmable read-only memory (ROM), a solid-state memory, an universal serial bus (USB) flash drive, a hard-disk drive, a magnetic tape or an optical disk.

Although the controller 30, memory 32 and LED drivers $\mathbf{24}_R$, $\mathbf{24}_G$, $\mathbf{24}_B$ and $\mathbf{24}_W$ are shown in FIGS. 2A and 2B as parts of a same group of control electronics 25, it will be readily understood that these components may be arranged in a variety of configurations without departing from the scope of the invention.

Method for Operating a LED System

In accordance with embodiments of the present invention, there is provided a method is for operating a LED lighting system at a target output color, the LED system having three or more LED emitters of different colors. As explained above, each LED emitter is operable at a controllable drive setting and has a junction temperature. The method allows finding the optimal drive setting for each LED emitter of the LED lighting system. Advantageously, this method can simultaneously take into account a specific target color and a specific target luminance, the two parameters fully defining target X, Y, Z tristimulus coordinates, and can maintain both parameters over variations of environment temperature. Furthermore, this can be accomplished without measuring the color of the light emitted by the LED lighting system, that is, no color feedback is required.

Although the method is described herein as applied to lighting systems such as those shown in FIGS. 2A and 2B, it will be readily understood that in other embodiments of the invention the present method may be used to control LED lighting systems having different configurations.

The method first includes a step of providing calibration data for each LED emitter at a plurality of values of the corresponding emitter drive setting and at a plurality of values of the corresponding junction temperature. In other words, a number of parameters is provided for each combination of junction temperature and emitter drive setting. The calibration data is represented by a set of calibration parameters, which preferably include, at a minimum, a voltage value and color point coordinates for each LED emitter for each drive setting and junction temperature combination, as explained in further details below. Additional parameters may be provided for LED lighting systems having more than three LED emitters, for example, data related to a LED color rendering index or luminous efficacy optimization.

Calibration Process

Figure 3:
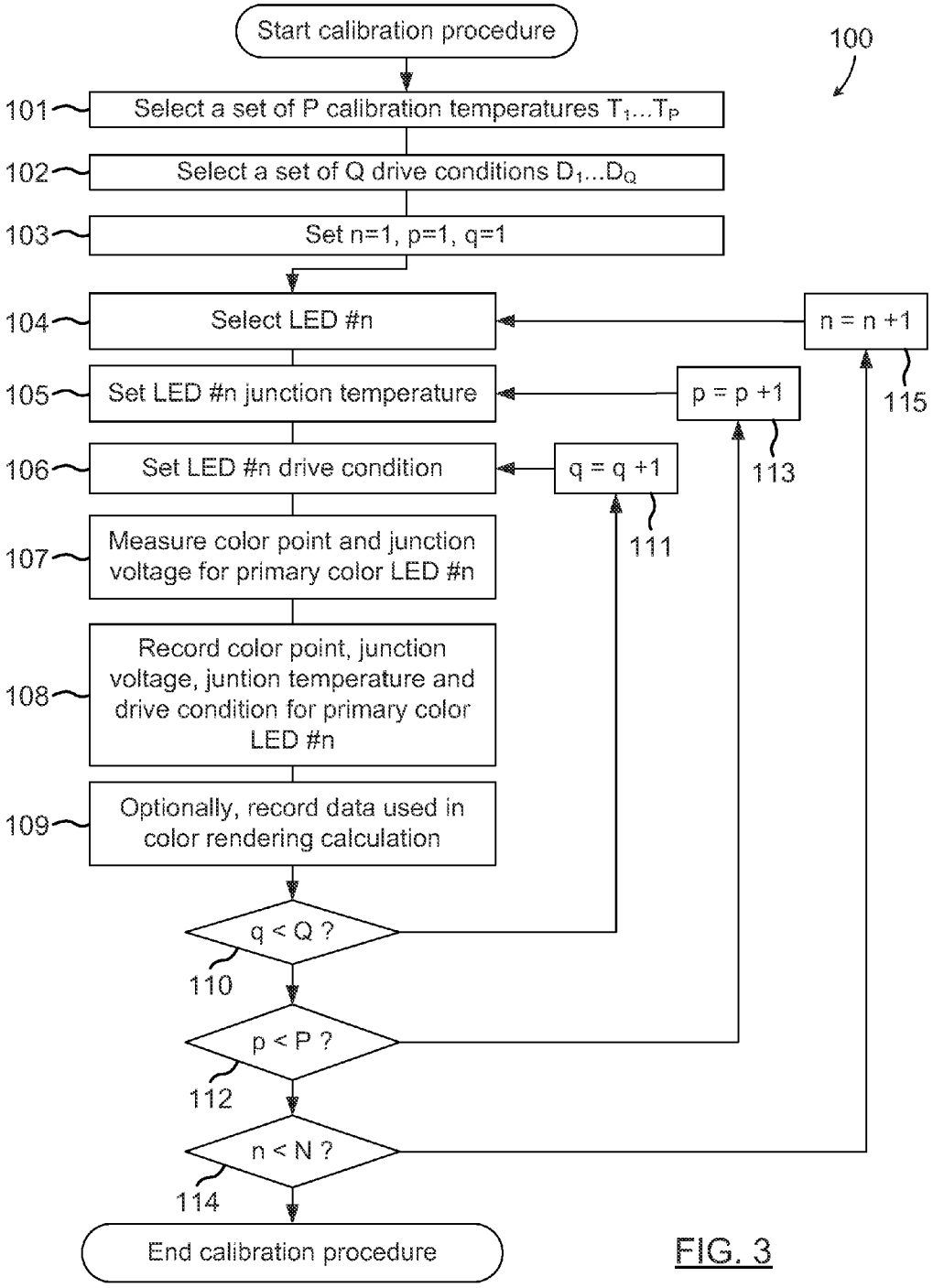
FIG. 3 is a flow chart of a calibration process according to one embodiment.

With reference to FIG. 3, there is shown a flow chart illustrating a calibration process 100 according to one embodiment of the invention, that is, a strategy for building the calibration data for a lighting system including N≥3 LED emitters. It will however be understood that the operation method described in a later section is independent of the process described herein to obtain the calibration data and that this process is shown by way of example only.

It is to be noted that, for simplicity, the description of the calibration process 100 assumes that the LED emitters are driven using a CC regulation scheme. However, adaptation of this process to PWM-driven LED emitters or to other driving methods would be straightforward to one skilled in the art.

Preferably, the calibration process 100 is performed with the lighting system placed in a temperature controlled environment. The temperature of the environment is controlled in such a way that the junction temperature of each LED emitter can be fixed to a known value. Preferably, each LED emitter is mounted on a temperature controlled plate (not shown). Referring to FIG. 3, an appropriate calibration set of P junction temperature values $T_1, \ldots, T_P$ is chosen (101). The temperature limits are preferably fixed by the maximum and minimum operating temperatures of the LED.

An appropriate calibration set of Q drive settings $D_1, \ldots, D_Q$ is also selected (102), that is, a group of values for the drive settings. In the illustrated example the driver is a constant current regulated driver, and the calibration is performed over a range of current values $D_1=I_{min}$ to $D_Q=I_{max}$. If a PWM driving scheme was used, the drive settings would be duty cycle values.

The numbers of drive setting and junction temperature values are preferably selected so that the calibration data efficiently covers the possible operating conditions of the LED emitters. By way of example only, the set of junction temperature values may range from 0° C. to 100° C. in 20° C. increments while the set of drive settings may be current values between 5 mA and 700 mA in 50 mA increments. Alternatively, instead of using fixed current increments, the increments may be smaller at low current values and larger when approaching the maximum operating current. For example, the current increments may be 10 mA from 5 mA to 100 mA and 50 mA from 100 mA to 700 mA. Current step optimization may provide better characterization of operating regions where the emitter color or luminance are the most sensitive to the injected current.

The illustrated calibration process 100 is performed sequentially for each of the n=1, . . . , N LED emitters of the lighting system, each of the p=1, . . . , P junction temperatures and each of the q=1, . . . , Q drive settings, in all possible combinations.

At the start of the process the three corresponding indices: n for the LED emitters, p for the junction temperature and q for the drive settings, are all set to 1 (103). For each measurement of calibration data a LED emitter n is selected (104), its junction temperature (105) its drive setting (106) are also set. Then, for a given junction temperature the calibration parameters are measured and recorded for each drive setting value. As will be further explained below, in the illustrated embodiment the color point and junction voltage of the currently considered LED emitter are measured (107), and the color point, junction voltage, junction temperature and drive setting are recorded (108). In the case involving more than three LED emitters, additional data may also be recorded (109), such as, for example, data used in color rendering or luminous efficacy calculation.

The process then involves checking if all the drive settings have been processed, that is, if q<Q (110) and if so, q is incremented (111) after each set of measurements. Once all drive setting values have been used, the process involves verifying if all temperature values have been processed, that is, if p<P (112) and if so p is incremented (113) and the same sequence is performed for the next junction temperature value. It will be readily understood that a different order may be followed, for example by first fixing the drive setting value and sweeping the different temperature values, as long as the calibration routine allows all the required data to be acquired.

Once all the calibration data has been obtained for a given LED emitter n, the process involves verifying if n<N at 114, and incrementing n (115) if it remains some LED emitters to be processed.

The calibration parameters are measured in this manner for each combination of LED emitter, junction temperature and current values.

Calibration Parameters

Referring to FIG. 4, there is shown an example of a calibration table according to an embodiment of the invention. As will be clear from the explanations given below, the illustrated table is suitable for describing one emitter n of a four-emitter lighting system such as the one illustrated in FIG. 2B.

The vertical axis of the illustrated calibration table lists the target junction temperatures $T_{J,n}$ and the horizontal axis the applied current values. As one skilled in the art will readily understand, applying a given junction temperature may for example involve applying a given setting to the temperature controlled plate on which the LED emitter is mounted. However, there may be some slight variations between the target junction temperature and the actual junction temperature of the LED emitter. Optionally, the calibration parameters may therefore include a measured value of the junction temperature $T_{J,n}$. This value may for example be obtained from the method described in Zong, Y. and Ohno, Y., "*New practical method for measurement of high-power LEDs", CIE Expert Symposium* 2008 *on Advances in Photometry and Colorimetry.* 2008, *Turin, IT: NIST*, the contents of which are incorporated herein by reference.

The calibration parameters preferably further include the junction voltage $V_{J,n}$. In the illustrated embodiments of FIGS. 2A and 2B, this may simply be measured using the corresponding voltage meters 28.

The calibration parameters further include data related to a measurement of the color of the light emitted by the corresponding LED emitter. The color of a light beam is determined by its spectral profile or spectrum S(λ), i.e., the variation of its intensity as a function of wavelength. For each emitter and at each calibration condition, the measurement of the calibration parameters may for example include a measurement of the spectrum S(λ) of the light emitted from the LED emitter, using an appropriate spectrally-resolved light detector such as a spectroradiometer (not shown).

As recording spectra for a large number of junction temperatures and current values for each LED emitter would require a significant processing and storage capacity, it can be preferable to use color point coordinates in a predetermined color space. In accordance with one embodiment of the invention, the color point coordinates are preferably tristimulus coordinates X, Y and Z. The tristimulus coordinates are defined relative to color matching functions related to the perception of colors by the photoreceptors, or cones, of the human eye. By definition, the Y coordinate corresponds to the luminance, Z is nearly equal to blue stimulation and X is a mix of cone response curves chosen to be non-negative.

From a recorded light spectrum S(λ) the tristimulus coordinates are calculated as follows:

$$X = k\int_{\lambda} S(\lambda)\cdot CMF_X(\lambda)\,d\lambda$$

$$Y = k\int_{\lambda} S(\lambda)\cdot CMF_Y(\lambda)\,d\lambda$$

$$Z = k\int_{\lambda} S(\lambda)\cdot CMF_Z(\lambda)\,d\lambda$$

where k is a constant and $CMF_X$, $CMF_Y$ and $CMF_Z$ are the color matching functions specified by the CIE.

As shown in the calibration table of FIG. 4, the calibration parameters may therefore include the tristimulus coordinates $X_n$, $Y_n$ and $Z_n$ measured for each LED emitter n. Of course, the use of the standard CIE 1931 XYZ color space is shown here by way of example only, and in other embodiments any other convention allowing the calculation of color point coordinates from the recorded spectra could be used.

If the LED lighting system includes more than three LED emitters, additional parameters may be used and the calibration data may further include, for example, color rendering parameters used for calculation of a color rending metric, such as the Color Rendering Index (CRI) or the Color Quality Scale (CQS) or any other similar metric. In embodiments where the CRI or CQS is used, the color rendering parameters are obtained by calculating the spectrum of the light emitted from a given LED emitter after reflection on a reference sample. The CRI standard includes a total of 8 samples, whereas the CQS standard uses 15 samples. The collected spectra are used to calculate the following quantities:

$$X_{n,F} = k\int_{\lambda} S(\lambda)\cdot F(\lambda)\cdot CMF_X(\lambda)\,d\lambda$$

$$Y_{n,F} = k\int_{\lambda} S(\lambda)\cdot F(\lambda)\cdot CMF_Y(\lambda)\,d\lambda,$$

$$Z_{n,F} = k\int_{\lambda} S(\lambda)\cdot F(\lambda)\cdot CMF_Z(\lambda)\,d\lambda$$

where S(λ) is the measured spectrum of the LED emitter before reflection by the reference sample. F(λ) is the reflectance spectrum of the reference sample F (this may be measured or CIE standard reflectance curves may be used), the product S(λ)·F(λ) represents the spectrum reflected by the reference sample F when illuminated by the LED emitter, and $CMF_X$, $CMF_Y$, $CMF_Z$ are again the CIE 1931 standard color matching functions, or any other suitable definition of color matching functions. It is to be noted that, in practice, the F(λ) reflectance curves are known as values tabulated versus wavelength. For example, the reflectance curves of reference samples used for the calculation of CRI are available from the CIE. Hence, only the spectrum S(λ) of the LED emitter before reflection by the reference sample is typically measured. The equations above are calculated for all reference samples, and the corresponding sets of coordinates recorded in the calibration table. By way of example, the calibration table of FIG. 4 is based on the CQS standard and therefore includes 15 sets of coordinates $X_{n,F}[1 \ldots 15]$, $Y_{n,F}[1 \ldots 15]$ and $Z_{n,F}[1.15]$ at each entry.

Operation of the LED Lighting System

Figure 5:
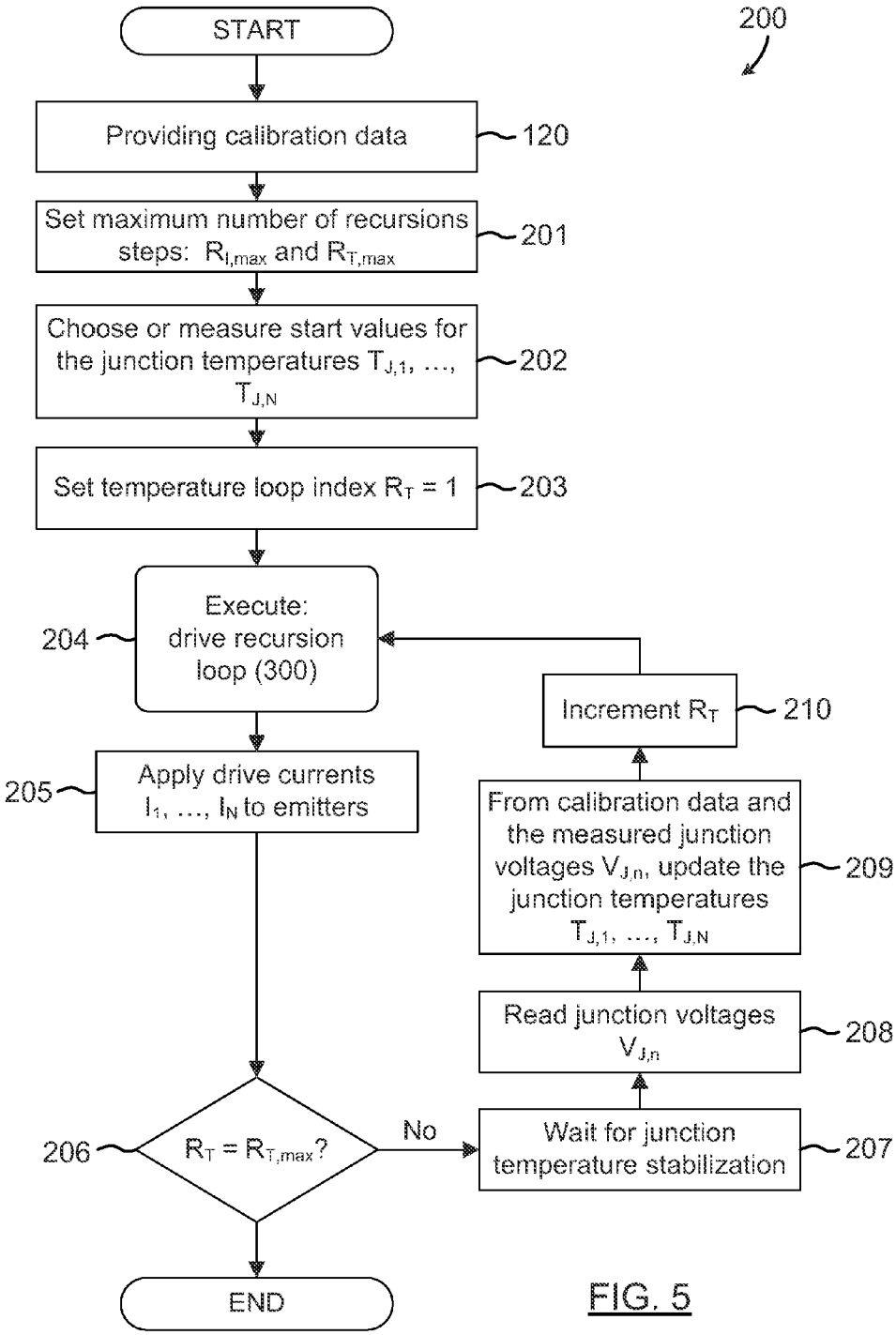
FIG. 5 is a flow chart of a method for operating a LED lighting system according to one embodiment.

Referring to FIG. 5, there is shown a flow chart illustrating the steps of a method 200 of operating a LED lighting system according to one embodiment of the invention.

As explained above, the target output color corresponds to the color that is to be produced by combining the outputs of all the LED emitters of the LED lighting system. In the present embodiment, the target output color is represented by tristimulus coordinates X, Y, Z.

The method first includes providing the calibration data (120). Preferably, the calibration data includes a voltage value and color point coordinates for each LED emitter at each one of the plurality of values of the drive setting and junction temperature. A measured value for the junction temperature may optionally be included. In cases where the LED lighting system includes more than three LED emitters, additional data such as color rendering parameters are preferably provided.

The calibration data may have been obtained according to the process described above, and stored in a suitable location so as to be accessible during operation of the LED lighting system. In the embodiments of FIGS. 2A and 2B, the calibration data is stored in the memory 32. One skilled in the art will understand that the calibration data may be stored in a different location and provided for use by any appropriate means of communication. It will further be understood that the calibration process may have been performed at a different time and location than the operation of the LED lighting system, which may for example be supplied in a pre-calibrated state to the user. As such, the method of operation need not have access to all the equipment and facilities required for the calibration process. Particularly, the method of operation does not require the measurement and analysis of the emission spectra of the LED emitters.

As explained in more details below, the method 200 is based on a drive recursion loop 300 which calculates the drive setting of each LED emitter based on an input value of its junction temperature, in view of the target output color and of the calibration data. The drive recursion loop is repeated for a number of iterations of the input temperature, counted in the illustrated flow chart by a temperature loop index $R_T$. The loop formed by steps 204 to 210 in FIG. 5 is referred to as the temperature loop. Preferably, the maximum number of iterations $R_{T,max}$ of the temperature loop can be determined in advance as a preliminary step 201. Alternatively, the maximum number of iterations can be determined during the execution of the algorithm by observing the stabilization of the solution provided by the drive recursion loop 300 over successive executions of the temperature loop. For example, in a system employing a CC driving method the maximum number of iterations of the temperature loop can be determined by observing the variation of the drive currents $I_1, \ldots, I_N$ over two successive temperature loop executions: the loop ends when the current values vary by less than 1 mA, or by less than any other appropriate value. In typical embodiments, a small number of iterations can suffice to obtain a stable solution, and the maximum number of iterations $R_{T,max}$ may be as small as 3.

Each iteration of the drive recursion loop uses an input value for the junction temperature of each emitter. In the first iteration a start value for the junction temperature of each emitter $T_{J,n}=T_{J,1}, \ldots T_{J,N}$ is preferably chosen or measured (202). In one embodiment, the input value of the junction temperature of each emitter is set to the environment temperature, i.e., the temperature of the environment of the lighting device. It will be understood that the environment temperature may differ depending on the location where it is measured, for example whether such measurement is taken inside or outside of the casing or packaging that houses the LED emitters, and that such differences are immaterial to the invention as the environment temperature is simply used as a starting value for an iterative process.

The environment temperature may be obtained through any suitable temperature measuring device or simply estimated.

The temperature loop index $R_T$ is set to 1 (203) and the drive recursion loop is executed (204) for a first time.

Figure 6A:
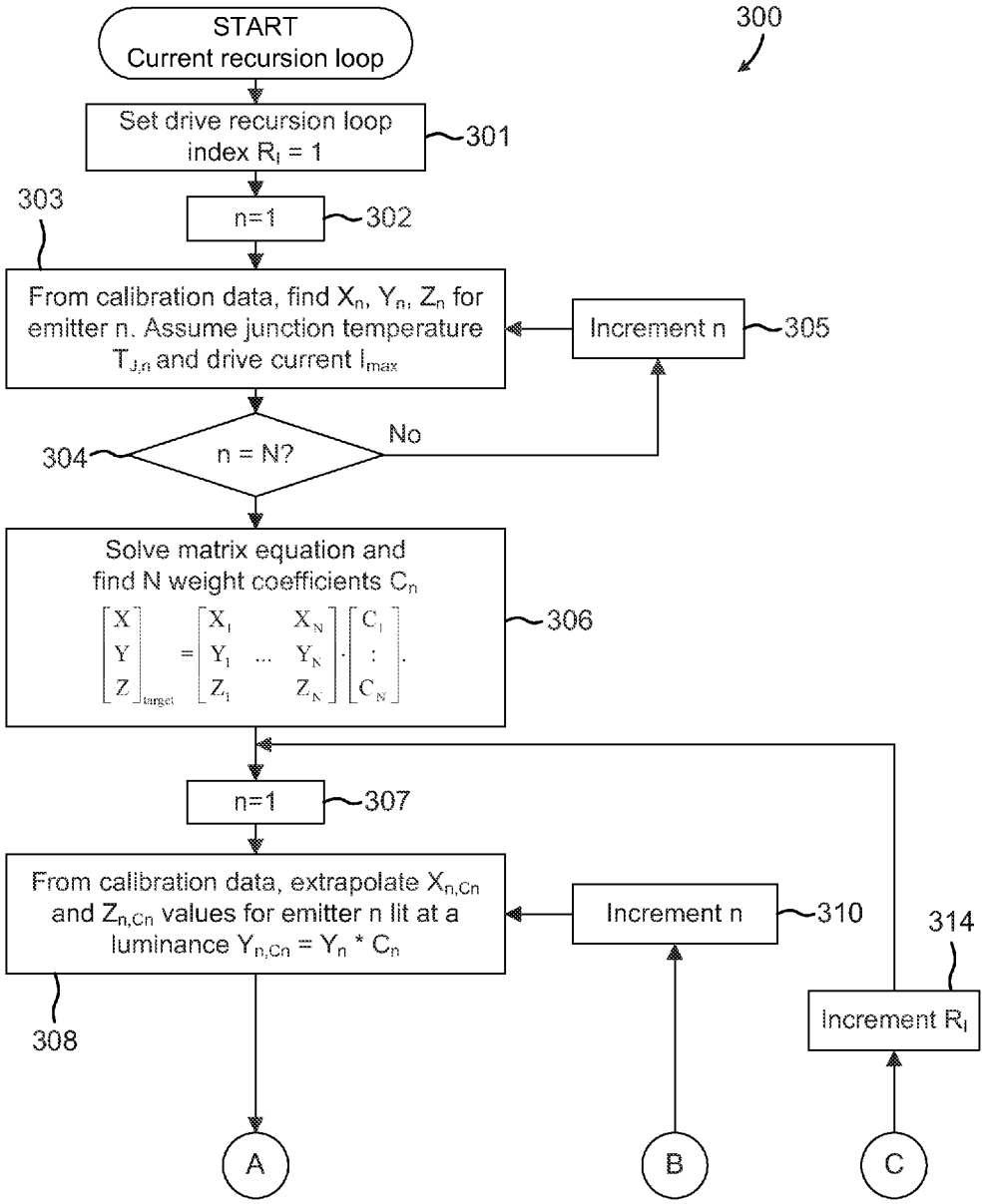
FIGS. 6A and 6B show a flow chart of a current recursion loop according to one embodiment.
Figure 6B:
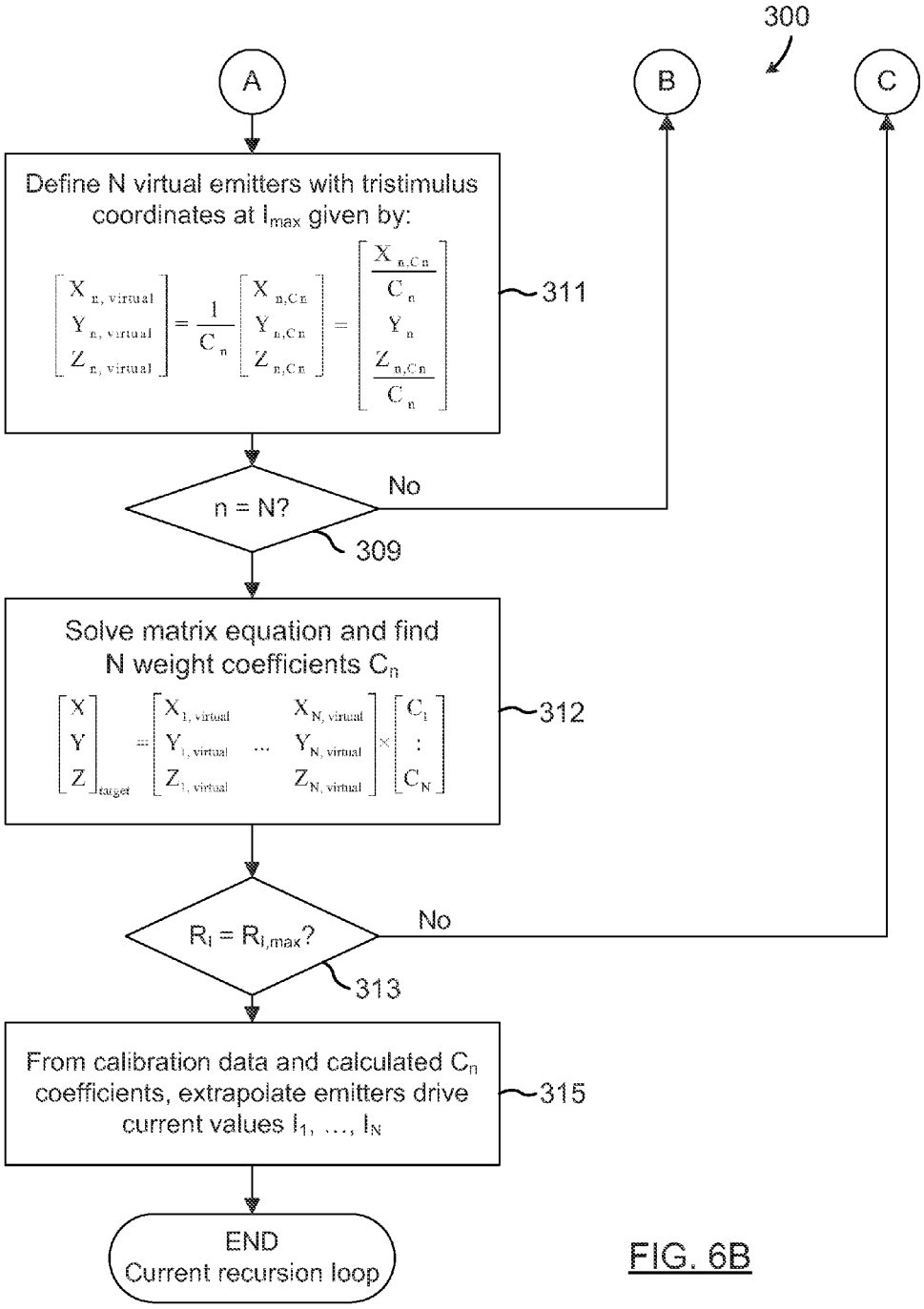

Referring to FIGS. 6A and 6B, a drive recursion loop 300 according to one embodiment of the invention will now be described.

As its name entails, the drive recursion loop 300 is performed for several iterations of drive setting values, and therefore a drive recursion loop index $R_I$ is used and first set to 1 (301). The maximum number of iterations of the calculations within the drive recursion loop can be predetermined, and can for example be set to the desired number $R_{I,max}$ at the same time as setting $R_{T,max}$ at step 201 (see FIG. 5). Alternatively, the maximum number of iterations can be determined during the execution of the algorithm by observing the stabilization of the solution provided by the drive recursion loop 300. For example, in a system employing a CC driving method the maximum number of iterations can be determined by observing the variation of the $C_n$ coefficients over two successive loop executions: the drive recursion loop ends when the $C_n$ coefficients vary by less than 0.1%, or by less than any other appropriate value. Typically, the solution to the drive recursion loop can be stable within 3 to 5 iterations.

The recursion loop 300 preferably includes establishing a start value for the drive setting of each LED emitter. For the illustrated embodiment this start value is for example chosen as the maximum current value $I_{max}$ which can be applied to the corresponding LED emitter. Similarly, if the drive setting is a current modulation duty cycle, then the start value of the drive setting of each emitter could for example be an 100% duty cycle. Other values could of course be used without departing from the scope of the invention. It will also be noted that in the illustrated embodiment $I_{max}$ is considered the same for all of the N LED emitters, but that in other embodiments different start values could be used for the drive setting of different LED emitters.

From the above it can be seen that a junction temperature $T_{J,n}$ and a drive current value $I_{max}$ have now been assumed for each LED emitter. The drive recursion loop preferably includes determining, from the calibration data, the color point coordinates of each emitter at the assumed start value of the drive setting $I_{max}$ and input temperature $T_{J,n}$ of the emitter. This may simply be achieved by setting n=1 (302), accessing the calibration table for LED emitter 1 and finding (303) the color point coordinates for the table entry combining temperature $T_{J,1}$ and drive setting $I_{max}$. In the case wherein the color point coordinates are tristimulus coordinates X, Y and Z in the standard CIE 1931 XYZ color space, the coordinates $X_1$, $Y_1$ and $Z_1$ are therefore obtained. The drive recursion loop then verifies (304) if n=N, and if not increments n (305) until color point coordinates for all the LED emitters have been obtained.

The next step of the drive recursion loop 300 involves calculating (306) the color weight coefficients $C_1, \ldots C_N$ in view of the color point coordinates determined in the previous step and of the color point coordinates X, Y, Z of the target output color. In the illustrated embodiment, this is accomplished by solving the matrix equation:

$$\begin{bmatrix} X \\ Y \\ Z \end{bmatrix}_{target} = \begin{bmatrix} X_1 & & X_N \\ Y_1 & \dots & Y_N \\ Z_1 & & Z_N \end{bmatrix} \cdot \begin{bmatrix} C_1 \\ \vdots \\ C_N \end{bmatrix}.$$

Again, X, Y, Z are the color point coordinates of the target output color, each value taken by the index n=1, . . . , N refers to one of the LED emitters, $X_n$, $Y_n$ and $Z_n$ are the tristimulus coordinates of the LED emitter n obtained from the calibration data and $C_n$ is the color weight coefficient associated to the LED emitter n.

For a LED system with N=3 emitters, the matrix equation is fully determined by the conditions imposed by the target X, Y, and Z color coordinates: a single solution exists, which is found by:

$$\begin{bmatrix} C_1 \\ \vdots \\ C_N \end{bmatrix} = \begin{bmatrix} X_1 & & X_N \\ Y_1 & \dots & Y_N \\ Z_1 & & Z_N \end{bmatrix}^{-1} \cdot \begin{bmatrix} X \\ Y \\ Z \end{bmatrix}_{target}.$$

where the superscript −1 indicates matrix inversion.

For a LED system having N>3 LED emitters, the color target alone is not sufficient to fully determine the solution to the matrix equation and additional conditions may be imposed. The description in the present section assumes that the system includes three emitters, and the extension of the described method to embodiments having a greater number of emitters will be explained further below.

Once initial values have been obtained for the weight coefficients $C_n$, the recursive portion of the loop can begin. Generally speaking, the drive recursion loop 300 aims to optimise the color weight coefficients by recursively recalculating them, using the color point coordinates for virtual emitters based on the color weight coefficients calculated in the previous recursion step and the calibration data.

In the illustrated embodiment, the optimisation of the weight coefficients first involves evaluating corrected tristimulus coordinates $X_{n,Cn}$, $Y_{n,Cn}$, and $Z_{n,Cn}$ based on the weight coefficients and the calibration data. For a given emitter, this is preferably performed by considering the LED emitter to be lit at a luminance value:

$$Y_{n,Cn}=Y_n \times C_n,$$

$Y_n$ being the luminance measured at drive setting $I_{max}$. Then the calibration data is consulted to extrapolate the coordinates $X_{n,Cn}$ and $Z_{n,Cn}$ associated with the obtained luminance value $Y_{n,Cn}$. Note that typically $X_{n,Cn} \neq 0\ X_n \times C_n$, and $Z_{n,Cn} \neq Z_n \times C_n$, as the emitter color points typically vary nonlinearly with injected current and, hence, with luminance. Such nonlinear behaviour is accounted for by extrapolating the $X_{n,Cn}$ and $Z_{n,Cn}$ from the calibration data.

Again, the N LED emitters are processed sequentially. The index n is first set to 1 (307). Then, the corresponding set of corrected tristimulus coordinates $X_{n,Cn}$, $Y_{n,Cn}$, and $Z_{n,Cn}$ (308) is evaluated.

The next step involves defining (311) N "virtual emitters", that is, emitters having color point coordinates $X_{n,virtual}$, $Y_{n,virtual}$ and $Z_{n,virtual}$ calculated as follows:

$$\begin{bmatrix} X_{n,virtual} \\ Y_{n,virtual} \\ Z_{n,virtual} \end{bmatrix} = \frac{1}{C_n} \begin{bmatrix} X_{n,Cn} \\ Y_{n,Cn} \\ Z_{n,Cn} \end{bmatrix} = \begin{bmatrix} \frac{X_{n,Cn}}{C_n} \\ Y_n \\ \frac{Z_{n,Cn}}{C_n} \end{bmatrix}$$

As one skilled in the art will readily understand, these are considered virtual emitters since they do not emit the same color at maximum drive conditions as the real emitters—in other words, the real LED emitters have different X and Z values at maximum drive conditions. This definition of virtual emitters allows for correcting the nonlinear variations of $Z_n$ and $X_n$ with the variations of drive conditions $C_n$.

The recursion loop then involves verifying if n=N (309) and incrementing n (310) until all LED emitters have been considered.

Next, the following matrix equation is solved (312) for the virtual emitters defined by the previous calculations, still using the tristimulus coordinates for the target output color:

$$\begin{bmatrix} X \\ Y \\ Z \end{bmatrix}_{target} = \begin{bmatrix} X_{1,virtual} & & X_{N,virtual} \\ Y_{1,virtual} & \dots & Y_{N,virtual} \\ Z_{1,virtual} & & Z_{N,virtual} \end{bmatrix} \times \begin{bmatrix} C_1 \\ \vdots \\ C_N \end{bmatrix}$$

The solution of this matrix equation provides new values for the weight coefficients $C_n$. These coefficients are then used as new inputs for the recursive portion of the drive recursion loop 300. The method therefore verifies if the recursion loop index $R_I$ has reached its maximum value $R_{I,max}$ (313) and, if not, $R_I$ is incremented (314). Another pass is made in the optimisation of the color weight coefficients by extrapolating the corrected tristimulus coordinates $X_{n,Cn}$, $Y_{n,Cn}$, and $Z_{n,Cn}$ based on the new input value of $C_n$ (308), defining new virtual emitters (311) and solving the matrix equation therefor (312).

After the required number of iterations $R_{I,max}$ have been performed, the final values obtained for the weight coefficients $C_n$ are used to determine (315) the drive setting for each emitter. This determination is based on both the color weight coefficients after the $R_{I,max}$ iterations have been performed and on the calibration data. In practice, this can be accomplished by extrapolating the drive setting value for which each emitter n has a measured luminance $Y_{n,Cn}=Y_n \times C_n$, $Y_n$ being the luminance measured at maximum drive setting $I_{max}$.

Referring back to FIG. 5, after the drive recursion loop has been executed and the drive settings obtained, these drive settings are then applied to the LED emitters (205). The temperature recursion index is verified at 206, and if the maximum number of iterations has not been reached then an operation value for the junction temperature of each LED emitter is determined to serve as input temperature value to the next execution of the drive recursion loop. In this illustrated embodiment, the operation value for the junction temperature is obtained by waiting for a stabilisation period, so that the junction temperature of each emitter stabilizes (207). Typically, the stabilization period can be as short as a fraction of a second to a few seconds. Then, the junction voltage of each LED emitter is measured (208) and the corresponding junction temperature is estimated (209) from the measured junction voltage and the calibration data. A set of N junction temperatures is therefore obtained. The temperature recursion index $R_T$ is incremented (210) and the drive recursion loop executed again (204), using the operation value of the junction temperature of each emitter as the input value therefor.

The method described above may be performed at the time of lighting of the LED lighting system at the desired output color. In some embodiments, the temperature and operating conditions of the LED emitters may be assumed stable enough to trust that the target color will be maintained for as long as the LED lighting system is lit. In other embodiments, the method above may be repeated periodically to ensure that a is change in operating conditions or environment temperature has not degraded the color quality. In some embodiments, the method may be repeated at preprogrammed time intervals. In other embodiments one or more factors representative of the operating conditions or color quality of the LED lighting system may be monitored and the method above repeated when a given threshold is met. In other embodiments, the method may be performed again whenever desired by the user.

Control of LED Lighting Systems Having More than Three LED Emitters

As mentioned above, in embodiments where the LED lighting system includes only three LED emitters, the matrix equation is fully determined by the conditions imposed by the target X, Y, and Z color coordinates. Hence, only one solution exists, which is found by matrix inversion. For a LED system with N≥4 emitters, the algorithm is identical but the matrix equation is under-determined and has an infinite number of solutions, all providing the same target color. Various approaches may be used to select a particular solution. The selection of one preferred solution requires imposing additional conditions. Such conditions may be expressed by linear or nonlinear equations that are functions of the weight coefficients $C_n$ or, equivalently, of the emitter drive conditions. One solution can for example be chosen by applying a strategy such as the one disclosed in patent application US 2010/0060185 A1, which aims to minimize power consumption and in which linear conditions are imposed. In another example, a mathematical method based on the so-called Moore-Penrose inverse can be used to select one solution.

In accordance with one embodiment of the present invention, an optimum solution can be chosen that not only provides the target color but also meets a color rendering metric such as the CQS or CRI. In this embodiment, the $X_{n,F}$, $Y_{n,F}$, $Z_{n,F}$ color rendering parameters pre-calculated during the calibration process and stored in the calibration table may be used to calculate the color rendering metric for several solutions. It is of note that the color rendering metrics are nonlinear functions of the drive conditions $C_n$. Hence, linear matrix-based solution techniques cannot be used. Instead, well-known nonlinear optimization techniques can be used to select the solution that meets the following criteria:

Maximum color rendering metric $0 \le C_n \le 1$ for all emitters, which means that the solution is physically achievable.

Experience shows that in LED systems with N=4 emitters, the CRI and CQS are well behaved functions of the drive condition of any single one of the four emitters, the drive conditions for the other three emitters being fixed by the requirements related to the target color point. The functions are well behaved in the sense that they have a single absolute maximum. One brute force optimization technique may simply be based on solving the matrix equation repeatedly with the weight coefficient C of one emitter fixed at a value sweeping between 0 and 1 by discrete steps. For every step, the CRI or CQS is estimated and the procedure stops as soon as a maximum for the selected metric is found. Any solution selection technique should take into account the fact that the weight coefficients $C_n$ take on values lying between 0 and 1, those limits corresponding to an emitter completely off and lit at maximum drive condition, respectively. In case of conflicting optimization targets, the $0 \le C \le 1$ condition for all emitters should prevail.

Figure 7:
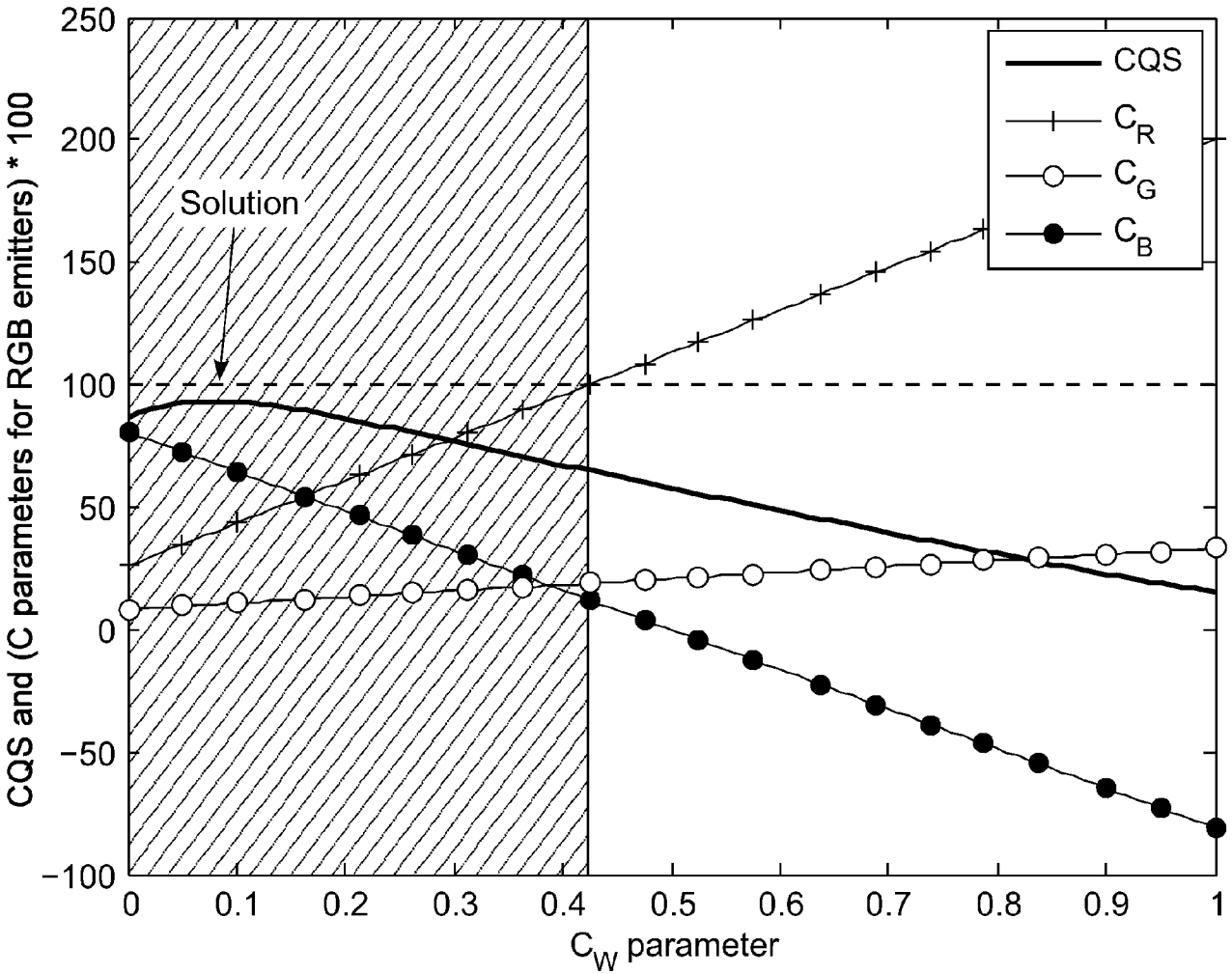
FIG. 7 is a graph showing an example of the selection of weight coefficients as part of the control of a LED lighting system according to one embodiment.
Figure 8:
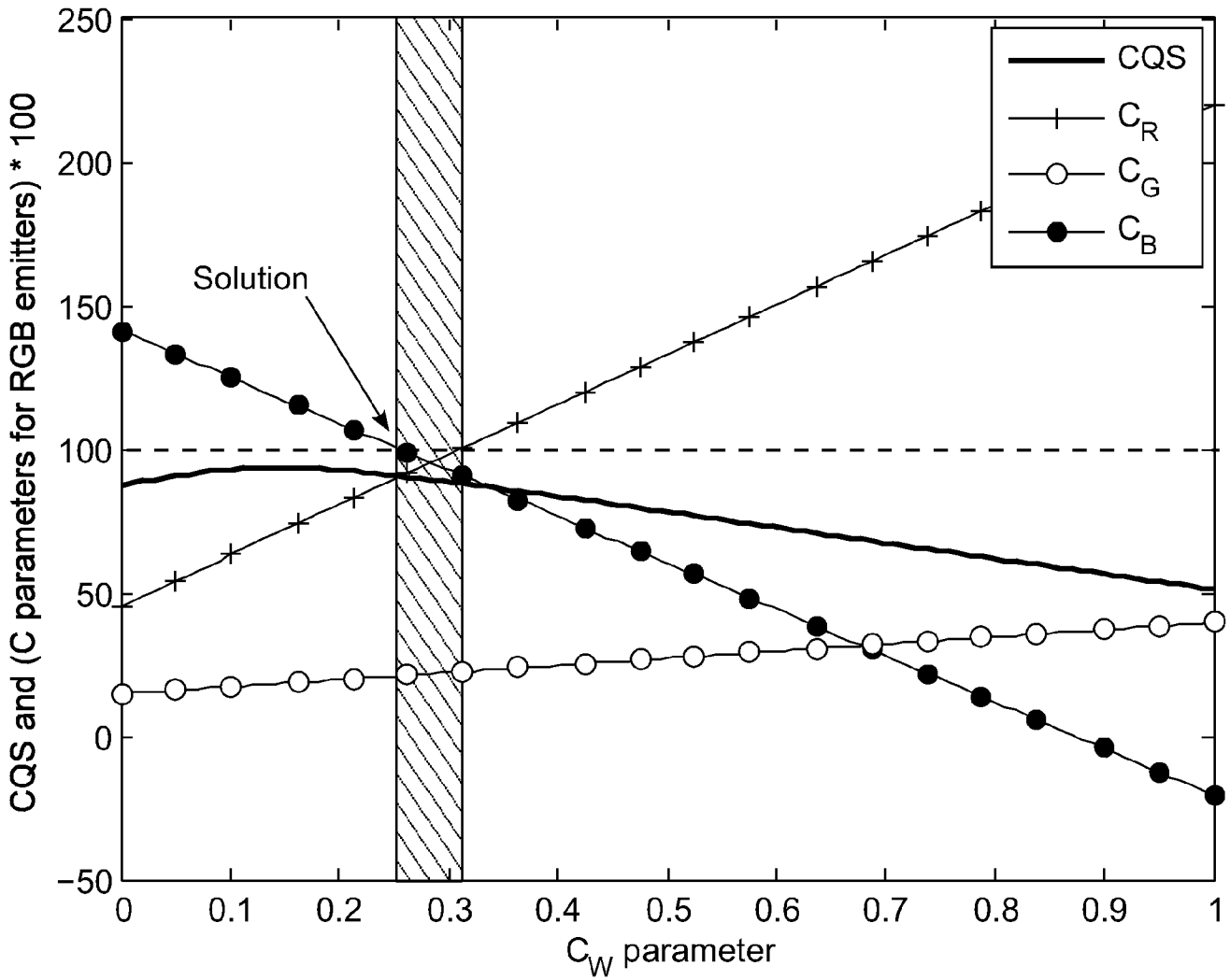
FIG. 8 is a graph showing another example of the selection of weight coefficients.

By way of example, FIGS. 7 and 8 show the criteria for solution selection in a LED lighting system having four emitters, where a maximum CQS is sought. In FIG. 7, the solution with maximum CQS for a RGBW LED lighting system is shown, in a situation where a solution is achieved within drive condition limits. The hatched area is the accessible region with $0 \le C \le 1$ for all emitters. $C_R$, $C_G$, $C_B$, $C_W$ are the weight coefficients for the red, blue, green and white emitters, respectively. FIG. 8 shows a solution with maximum CQS for a similar system in a situation where the solution is constrained by the region of feasibility. In this solution, the red LED emitter is turned on at maximum drive condition and the CQS is slightly below the theoretical maximum, which is not accessible with $0 \le C \le 1$ for all emitters. The hatched area represents the accessible region with $0 \le C \le 1$ for all emitters.

Experimental Results

Figure 9:
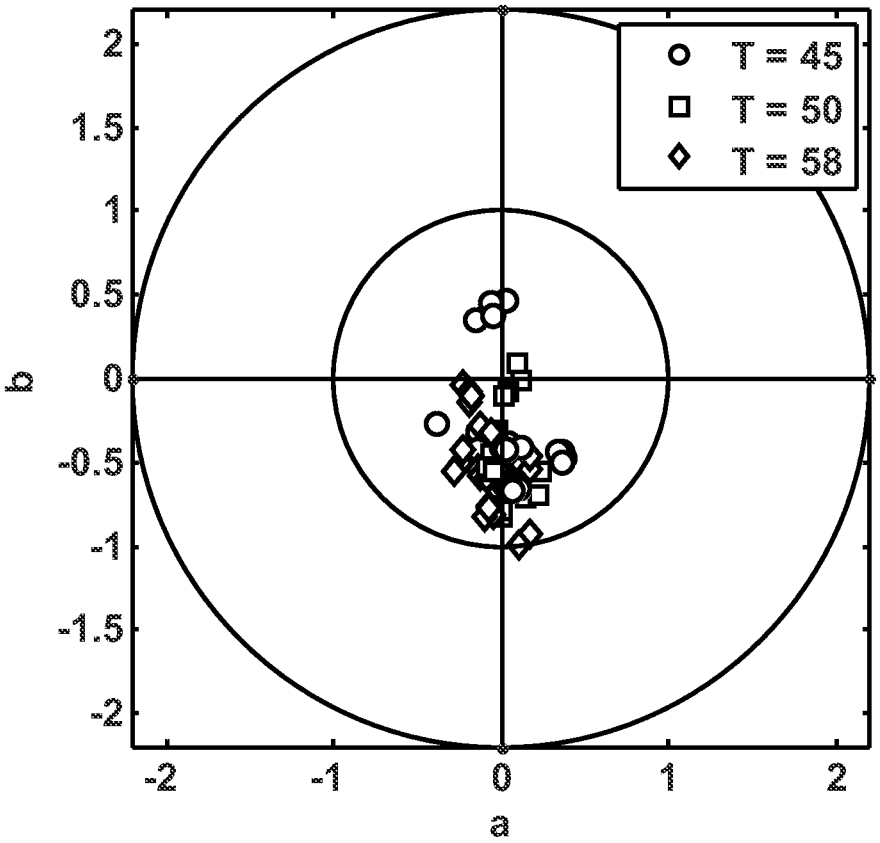
FIG. 9 illustrates the quality of the color control obtained using an embodiment of the invention for a LED lighting system having four LED emitters.
Figure 10:
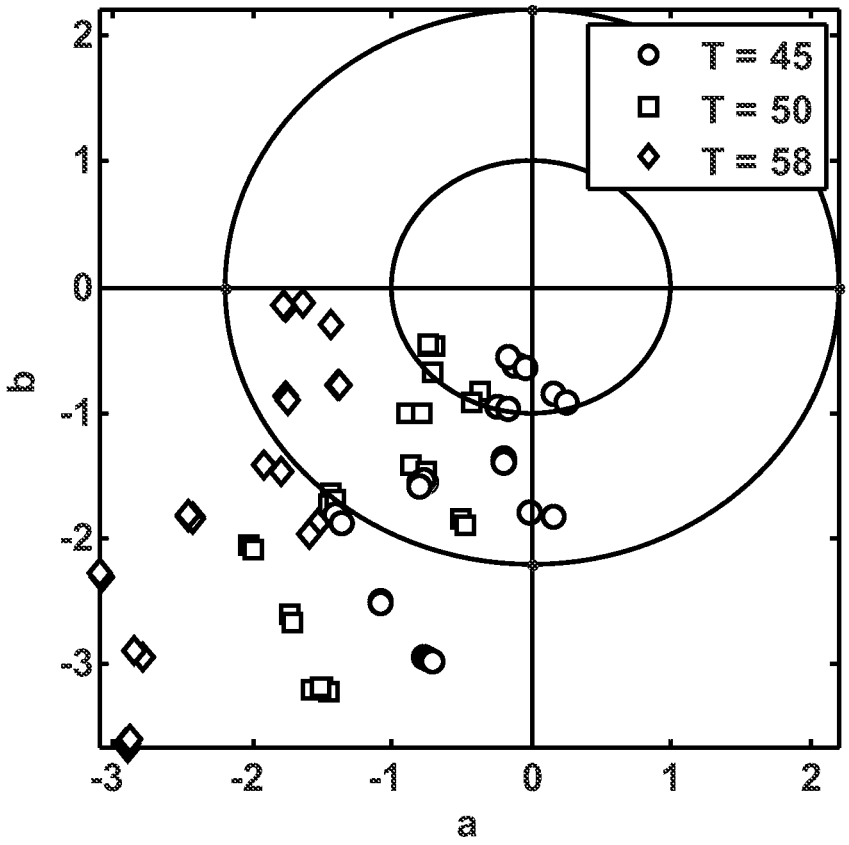
FIG. 10 contrasts the quality of the color control obtained with the same system but without using the teachings of the present invention.
Figure 11:
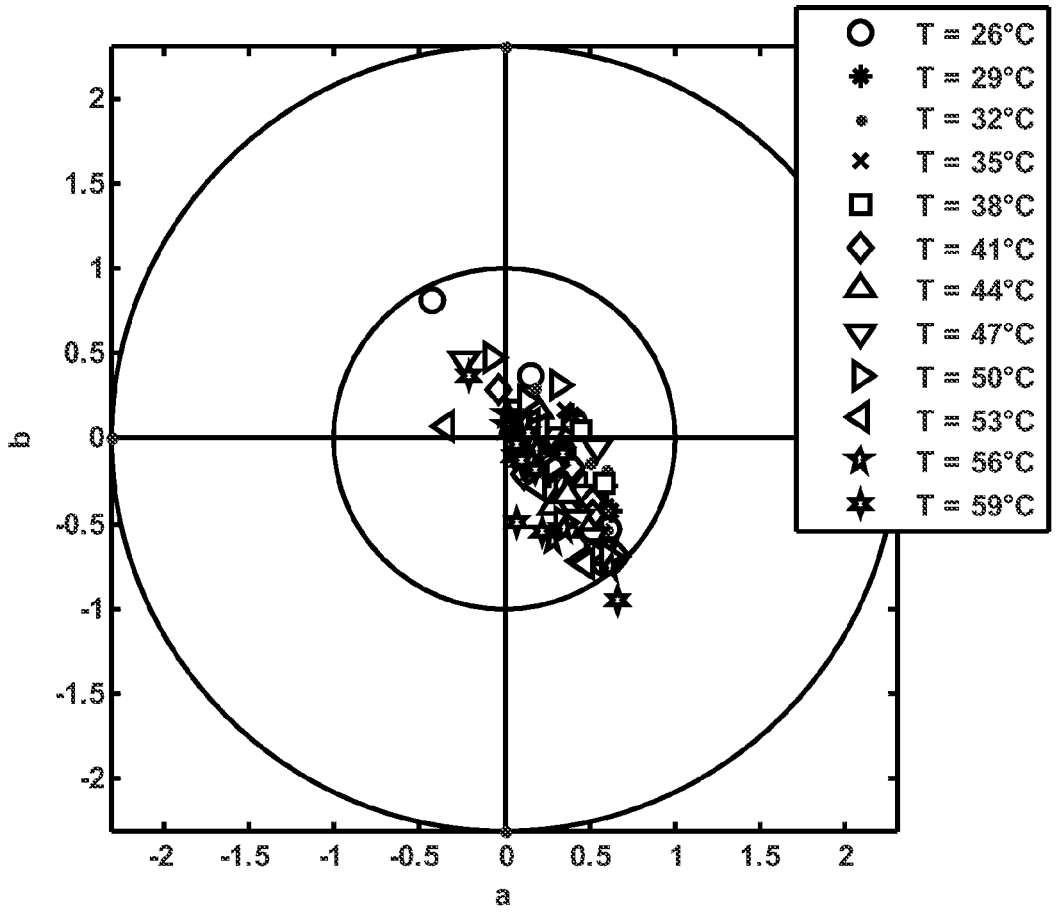
FIG. 11 illustrates the quality of the color control obtained using an embodiment of the invention for another LED lighting system having four LED emitters.

FIGS. 9 to 11 demonstrate that the method for operating a LED lighting system according to embodiments of the invention allows properly maintaining color within the color difference perception limit of the eye for various dimming and environment temperature settings. It is also shown that the color error is significant when the temperature is neglected.

All the solutions presented in these figures also have the property of providing maximum CQS or CRI. The maximum accessible CRI or CQS depends on the spectral features of the controlled LEDs as well as on the drive settings determined by the control algorithm. In all illustrated examples the target color point was set at the white provided by the CIE standard D65 illuminant, corresponding approximately to the white light from a mid-day sun in Western Europe/Northern Europe. Of course, this choice is not considered limitative to the scope of the invention. Also, in all these figures, the LEDs are controlled by a CC driving method, although a PWM driving method could be used with similar or better results.

FIG. 9 illustrates the color control of a first commercially available LED lighting system having 4 LED emitters over various dimming levels, represented by flux from a normalized value of 1 to 3.2, and environment temperature varying from 45° C. to 58° C. The target color in this example is D65 white in the CIELAB color space. The color difference between the actual LED color and the target color was calculated using the CIE 1976 a,b (CIELAB) color difference formula. It is generally recognized that the color of a LED emitter is well maintained if ΔE*ab is less or equal to 1, ΔE*ab=1 being the limit of source color difference perception of the human eye. The internal and external circles represent the ΔE*ab=1 and ΔE*ab=2 limits, respectively. As can be seen, the solutions presented in this figure all maintain color within ΔE*ab<=1. All solutions were calculated by imposing maximum CQS criterion.

The results shown in FIG. 9 can be contrasted with those of FIG. 10, showing the control of the same LED lighting system in the same conditions but assuming that the environment temperature is constant at 45° C. instead of performing the method described herein. It can readily be seen that the color error rapidly grows above eye perceptibility limit for high-flux settings due to LED self-heating.

FIG. 11 illustrates the color control of a second commercially available LED lighting system having 4 LED emitters over various dimming levels, represented by flux from a normalized value of 1 to 3, and environment temperature varying from 26° C. to 59° C. The target color in this example is also D65 white in the CIELAB color space. Color is shown to be maintained within ΔE*ab<=1, except for one point at maximum environment temperature and flux. All solutions were calculated by imposing a maximum CRI criterion.

In summary, embodiments of the present invention provide for the controlled operation of a LED lighting system having three of more LED emitters that has several advantages over prior art. In contrast with many color control methods disclosed in previous art, the proposed color control method does not rely on the linearity of the relation between the PWM duty cycle and emitter intensity. Hence, the color is well controlled (ΔE*ab≤1) for either PWM or CC driving methods. Advantageously, the method presented herein does not rely on the use of color sensors for color feedback during operation of the system.

Of course, numerous modifications could be made to the embodiments described above without departing from the scope of the present invention as defined in the appended claims.

The invention claimed is:

1. A method for operating a LED lighting system at a target output color, the LED system having three or more LED emitters emitting light of different colors, each LED emitter being operable at a controllable emitter drive setting and having a junction temperature, the method comprising the steps of:

a) providing calibration data for each LED emitter at a plurality of values of the corresponding emitter drive setting and at a plurality of values of the corresponding junction temperature;

b) executing a drive recursion loop calculating the drive setting of each emitter based on an input value for the junction temperature of each emitter and in view of the target output color and of the calibration data;

c) applying the drive settings obtained at step b) to the LED emitters;

d) determining an operation value for the junction temperature of each LED emitter;

e) executing the drive recursion loop calculating the drive setting of each emitter using the operation value of the junction temperature of each emitter as the input temperature value therefor;

f) applying the drive settings obtained at step e) to the LED emitters; and g) repeating steps d) to f) for a predetermined number of times.

2. The method according to claim 1, wherein the drive recursion loop is executed at step b) using an environment temperature as the input value of the junction temperature of each emitter.

3. The method according to claim 1, wherein the calibration data comprises a junction voltage value and color point coordinates for each LED emitter, said junction voltage value and color point coordinates being determined for each one of the plurality of values of the drive settings and junction temperatures.

4. The method according to claim 3, wherein the drive recursion loop comprises:

i. establishing a start value for the drive setting of each LED emitter;

ii. determining, from the calibration data, the color point coordinates of each emitter at the corresponding start value of the drive setting and at the input temperature of the emitter;

iii. calculating color weight coefficients in view of the color point coordinates determined at sub-step ii. and of color point coordinates of the target output color;

iv. optimising the color weight coefficients by recursively recalculating the same, using the color point coordinates for virtual emitters based on said color weight coefficients and the calibration data; and v. determining the drive setting for each emitter based on the color weight coefficients after optimisation thereof and on the calibration data.

5. The method according to claim 4, wherein the color point coordinates for each LED emitter and the color point coordinates of the target output color are tristimulus coordinates X, Y and Z in the standard CIE 1931 XYZ color space, the calculating of the color weight coefficients comprising solving a matrix equation:

$$\begin{bmatrix} X \\ Y \\ Z \end{bmatrix}_{target} = \begin{bmatrix} X_1 & & X_N \\ Y_1 & \dots & Y_N \\ Z_1 & & Z_N \end{bmatrix} \cdot \begin{bmatrix} C_1 \\ \vdots \\ C_N \end{bmatrix}.$$

where values of index n=1, . . . , N correspond to the LED emitters, $X_n$, $Y_n$ and $Z_n$ are the tristimulus coordinates of emitter n obtained from the calibration data and $C_n$ is the color weight coefficient of emitter n.

6. The method according to claim 5, wherein each recursion of the optimising of the color weight coefficients comprises evaluating corrected tristimulus coordinates $X_{n,Cn}$, $Y_{n,Cn}$, and $Z_{n,Cn}$ based on the color weight coefficients and the calibration data, calculating the color point coordinates of the virtual emitters $X_{n,virtual}$, $Y_{n,virtual}$ and $Z_{n,virtual}$ such that:

$$\begin{bmatrix} X_{n,virtual} \\ Y_{n,virtual} \\ Z_{n,virtual} \end{bmatrix} = \frac{1}{C_n} \begin{bmatrix} X_{n,Cn} \\ Y_{n,Cn} \\ Z_{n,Cn} \end{bmatrix} = \begin{bmatrix} \frac{X_{n,Cn}}{C_n} \\ Y_n \\ \frac{Z_{n,Cn}}{C_n} \end{bmatrix}$$

and solving the matrix equation for said virtual emitters.

7. The method according to claim 3, wherein the LED lighting system has four or more of said LED emitters and the calibration data further comprises color rendering parameters related to a color rendering metric.

8. The method according to claim 7, wherein the color rendering metric is a Color Rendering Index or a Color Quality Scale.

9. The method according to claim 8, wherein the color rendering parameters comprise is tristimulus coordinates of the light emitted from the LED emitters and then reflected off a reference sample.

10. The method according to claim 3, wherein the LED lighting system has four or more of said LED emitters and the calibration data further comprises data related to luminous efficacy optimization.

11. The method according to claim 1, wherein the emitter drive setting of each LED emitter is a drive current value.

12. The method according to claim 4, wherein the emitter drive setting of each LED emitter is a drive current value, and wherein the start value of the drive setting of each emitter is a maximum drive current value.

13. The method according to claim 1, wherein the emitter drive setting of each LED emitter is a current modulation duty cycle.

14. The method according to claim 4, wherein the emitter drive setting of each LED emitter is a current modulation duty cycle, and wherein the start value of the drive setting of each emitter is an 100% duty cycle.

15. The method according to claim 1, wherein the determining an operation value for the junction temperature of step d) comprises, successively, for each LED emitter:

i. waiting for a stabilisation period;

ii. measuring a junction voltage of the LED emitter; and iii. estimating the junction temperature based on the measured junction voltage and the calibration data.

16. A LED lighting system for operation at a target output color, comprising:

three or more LED emitters emitting light of different colors, each LED emitter having a junction temperature;

a LED driver associated with each LED emitter, each LED driver being configured to apply a controllable emitter drive setting to the corresponding LED emitter;

a memory containing calibration data for each LED emitter at a plurality of values of the corresponding emitter drive setting and at a plurality of values of the corresponding junction temperature; and a controller configured to execute a drive recursion loop calculating the drive setting of each emitter based on an input value for the junction temperature of each emitter and in view of the target output color and of the calibration data, said controller being further configured to:

a) execute the drive recursion loop a first time using an initial junction temperature as the input temperature value therefor;

b) control each LED driver to apply the drive settings obtained through said recursion loop to the corresponding LED emitter;

c) determine an operation value for the junction temperature of each LED emitter;

d) execute the drive recursion loop using the operation value of the junction temperature of each emitter as the input value therefor;

e) control each LED driver to apply the drive settings obtained at step d) to the LED emitters; and f) repeat steps c) to e) for a predetermined number of iterations.

17. The system according to claim 16, further comprising a voltage meter associated with each LED emitter.

18. The system according to claim 16, wherein the calibration data comprises a junction voltage value and color point coordinates for each LED emitter, said junction voltage value and color point coordinates being determined for each one of the plurality of values of the drive settings and junction temperatures.

19. The system according to claim 18, wherein the drive recursion loop comprises:

i. establishing a start value for the drive setting of each of the LED emitters;

ii. determining, from the calibration data, the color point coordinates of each emitter at the corresponding start value of the drive setting and at the input temperature of the emitter;

iii. calculating color weight coefficients in view of the color point coordinates determined at sub-step ii. and of color point coordinates of the target output color;

iv. optimising the color weight coefficients by recursively recalculating the same, using the color point coordinates for virtual emitters based on said color weight coefficients and the calibration data; and v. determining the drive setting for each emitter based on the color weight coefficients after optimisation thereof and on the calibration data.

20. The system according to claim 19, wherein the color point coordinates are tristimulus coordinates X, Y and Z in the standard CIE 1931 XYZ color space, the calculating of the weight coefficients comprising solving a matrix equation:

$$\begin{bmatrix} X \\ Y \\ Z \end{bmatrix}_{target} = \begin{bmatrix} X_1 & & X_N \\ Y_1 & \dots & Y_N \\ Z_1 & & Z_N \end{bmatrix} \cdot \begin{bmatrix} C_1 \\ \vdots \\ C_N \end{bmatrix}.$$

where values of index n=1, . . . , N correspond to the LED emitters, $X_n$, $Y_n$ and $Z_n$ are the tristimulus coordinates of emitter n obtained from the calibration data and $C_n$ is the weight coefficient of emitter n.

21. The system according to claim 20, wherein each recursion of the optimising of the color weight coefficients comprises evaluating corrected tristimulus coordinates $X_{n,Cn}$, $Y_{n,Cn}$ and $Z_{n,Cn}$ based on the weight coefficients and the calibration data, calculating the color point coordinates of the virtual emitters $X_{n,virtual}$, $Y_{n,virtual}$ and $Z_{n,virtual}$ such that:

$$\begin{bmatrix} X_{n,virtual} \\ Y_{n,virtual} \\ Z_{n,virtual} \end{bmatrix} = \frac{1}{C_n} \begin{bmatrix} X_{n,Cn} \\ Y_{n,Cn} \\ Z_{n,Cn} \end{bmatrix} = \begin{bmatrix} \frac{X_{n,Cn}}{C_n} \\ Y_n \\ \frac{Z_{n,Cn}}{C_n} \end{bmatrix}$$

and solving the matrix equation for said virtual emitters.

22. The system according to claim 18, comprising four or more of said LED emitters, and wherein the calibration data further comprises color rendering parameters related to a color rendering metric.

23. The system according to claim 22, wherein the color rendering metric is a Color Rendering Index or a Color Quality Scale.

24. The system according to claim 23, wherein the color parameters comprise tristimulus coordinates of the light emitted from the LED emitters and then reflected off a reference sample.

25. The system according to claim 18, comprising four or more of said LED emitters, wherein the calibration data further comprises data related to luminous efficacy optimization.

26. The system according to claim 16, wherein the emitter drive setting of each LED emitter is a drive current value.

27. The system according to claim 19, wherein the emitter drive setting of each LED emitter is a drive current value, and wherein the start value of the drive setting of each emitter is a maximum current value.

28. The system according to claim 16, wherein the emitter drive setting of each LED emitter is a current modulation duty cycle.

29. The system according to claim 19, wherein the emitter drive setting of each LED emitter is a current modulation duty cycle, and wherein the start value of the drive setting of each emitter is an 100% duty cycle.

30. The system according to claim 16, wherein the determining an operation value for the junction temperature of step c) comprises, successively, for each LED emitter:

i. waiting for a stabilisation period;

ii. measuring a junction voltage of the LED emitter; and iii. estimating the junction temperature based on the measured junction voltage and the calibration data.

* * * * *